US005631076A

United States Patent [19]

Hakomori et al.

[11] Patent Number: 5,631,076

[45] Date of Patent: May 20, 1997

[54] HOT MELT INK THERMAL TRANSFER RECORDING SHEET

[75] Inventors: Masakazu Hakomori, Tokyo; Masatosi Maeda, Tomakomai; Yoshio Mizuhara, Kawasaki; Miwa Kimura, Tokyo; Toru Nakai, Chiba; Kosuke Asaeda, Tokyo; Tadahiro Nakada, Nagareyama; Masasi Oka, Chiba, all of Japan

[73] Assignees: New OJI Paper Co., Ltd.; Asahi Denka Kogyo K.K., both of Tokyo, Japan

[21] Appl. No.: 603,584

[22] Filed: Feb. 21, 1996

[30] Foreign Application Priority Data

| | | | |
|---|---|---|---|
| Feb. 24, 1995 | [JP] | Japan | 7-037170 |
| Mar. 13, 1995 | [JP] | Japan | 7-052543 |
| Apr. 14, 1995 | [JP] | Japan | 7-089602 |

[51] Int. Cl.[6] ..... B41M 5/00; B05D 3/02

[52] U.S. Cl. ..... 428/304.4; 428/195; 428/423.1; 428/913; 428/914; 427/385.5

[58] Field of Search ..... 428/195, 304.4, 428/423.1, 913, 914; 427/385.5

[56] References Cited

U.S. PATENT DOCUMENTS

| | | | |
|---|---|---|---|
| 5,252,531 | 10/1993 | Yasuda et al. | 428/195 |
| 5,455,217 | 10/1995 | Chang et al. | 428/195 |

FOREIGN PATENT DOCUMENTS

| | | |
|---|---|---|
| 0618079 | 10/1994 | European Pat. Off. . |
| 62-211195 | 9/1987 | Japan . |
| 64-27996 | 1/1989 | Japan . |
| 2-41287 | 2/1990 | Japan . |
| 2-89690 | 3/1990 | Japan . |
| 2-113990 | 4/1990 | Japan . |
| 4-189185 | 7/1992 | Japan . |
| 5-262057 | 10/1993 | Japan . |

*Primary Examiner*—Pamela R. Schwartz

*Attorney, Agent, or Firm*—Armstrong, Westerman, Hattori, McLeland, & Naughton

[57] ABSTRACT

A hot melt ink thermal transfer recording sheet having enhanced color density, continuous tone and dot-reproducibilities and color brightness has an ink-receiving porous polymer coating layer having a plurality of pores with an average size of 0.5 to 30 μm and an apparent density of 0.05 to 0.5 g/cm$^3$, and formed on a substrate sheet by coating a coating liquid comprising a polymeric material and fine air bubbles introduced by a mechanical agitation so as to increase the apparent volume of the coating liquid to up to ten times the original volume, the laminate of the substrate with the ink-receiving porous polymer coating layer having a thermal conductivity of 0.25 W/(m.K) or less, as determined by the laser flash method.

15 Claims, No Drawings

HOT MELT INK THERMAL TRANSFER RECORDING SHEET

BACKGROUND OF THE INVENTION

1. Field of the Invention

The present invention relates to a hot melt ink thermal transfer recording sheet and a process for producing same. Particularly, the present invention relates to a hot melt ink thermal transfer recording sheet useful for recording thereon clear dotted ink images having a satisfactory color density, and enhanced continuous color tone reproducibility and dot reproducibility when subjected to a hot melt ink thermal transfer printer using a thermal head, and a process for producing same.

2. Description of the Related Art

It is known that a hot melt ink thermal transfer recording system equipped with a thermal transfer ink sheet and a thermal head has a simple mechanism and can be easily maintained and thus is widely utilized as a printer for word processors and facsimile machines. Usually, as a hot melt ink thermal transfer recording (image-receiving) sheet for the system, a fine paper sheet is utilized.

Recently, a thermal transfer full color image recording system was developed, and thus, to enhance the continuous color tone reproducibility, the conventional printer in which a continuous color tone is obtained without changing the size of the individual dots, was changed to a new type of printer in which the continuous color tone is obtained by changing the size of the individual dots. Also, the hot melt ink thermal transfer recording sheet for full color image-recording system in range of applications from low energy to high energy is required to have good recording qualities including an excellent dot reproducibility at which the dot forms of thermally transferred hot melt ink are faithfully recorded, and a high color density for which a sufficient amount of the hot melt ink must be transferred.

Also, since full colored images or pictures are required to be thermally transferred, the recording sheets for the full colored images must accommodate the requirement. When a conventional non-coated printing paper sheet is used for the hot melt ink thermal transfer full colored image-recording system, it often occurs that the color density of the recorded images decreases probably due to a low heat-insulating property of the paper sheet, and the dot reproducibility decreases probably due to a poor cushioning property of the paper sheet. Also, when the surface of the recording sheet is too rough, the resultant recorded images are unclear because of frequent occurrence of missing and/or partial ink dots. Further, when the recording sheet surface is too smooth, the printed ink images are not sufficiently anchored or fixed to the recording sheet surface, and returns back to the hot melt thermal transfer sheet, and thus the resultant recorded images are defective and unclear. The above-mentioned phenomena causes a decrease in the dot reproducibility. Beside the increase in the color density of the recorded images due to the low dot reproducibility, sometimes a decrease in color density of the recorded images occurs due to a low absorption of the ink by the hot melt ink-receiving layer.

Many attempts have been made to solve the above-mentioned problems. Japanese Unexamined Patent Publication Nos. 2-89,690 and 64-27,996 disclose an undercoat layer formed on a substrate sheet and containing hollow particles to enhance the cushioning property of the recording sheet. However, the resultant recording sheets of the prior arts are still unsatisfactory in the cushioning and heat-insulating effects. Also, when the hollow particles are soluble in an organic solvent of a coating liquid for the hot melt ink-receiving layer, it becomes necessary that the hollow particles are bonded by a specific binder consisting of a polymeric material resistant to the organic solvent or an overcoat layer comprising the polymeric material resistant to the organic solvent is formed on the hollow particle-containing ink-receiving layer. The necessity causes the resultant recording sheet to be complicated in constitution. In another attempt for solving the problems, Japanese Unexamined Patent Publication No. 2-41,287 discloses an ink image-recording sheet having an enhanced ink-receiving capacity and produced by forming a resin coating layer containing a component soluble in water on a substrate sheet comprising as a principal component, a plastic resin; and removing the water-soluble component from the resin coating layer by extraction. However, the resultant ink image-recording sheet is disadvantageous in that the highest color density of the recorded images is insufficient or the received ink images exhibit an insufficient gloss. Therefore this type hot melt ink image-recording sheet cannot fully meet the requirements. Also, this type of recording sheet is further disadvantageous in that since the substrate sheet comprises, as a principal component, a plastic resin, the recording sheet is difficult to recycle for reuse.

SUMMARY OF THE INVENTION

An object of the present invention is to provide a hot melt ink thermal transfer recording sheet useful for thermal transfer color printers and capable of recording clear hot melt ink images having a satisfactory color density and a high color brightness with a good dot reproducibility and continuous tone reproducibility, and a process for producing same.

The above-mentioned object can be attained by the hot melt ink thermal transfer recording sheet of the present invention, which comprises:

a substrate sheet; and an ink-receiving porous polymer coating layer comprising a polymeric material, laminated on a surface of the substrate sheet, provided with a plurality of pores in which those distributed in the surface portion thereof have an average size of 0.5 to 30 μm, and having an apparent density of 0.05 to 0.5 g/cm$^3$, the laminate of the substrate sheet with the ink-receiving porous resinous coating layer having a thermal conductivity of 0.25 W/(m.K) or less, determined by the laser flash method.

The process of the present invention for producing the above-mentioned hot melt ink thermal transfer recording sheet comprises the steps of:

mechanically agitating a coating liquid containing a polymeric material to an extent such that a large number of fine air bubbles independent from each other and having an average size of 0.5 to 30 μm are introduced into the coating liquid and the resultant bubbled coating liquid has a total volume larger than but not more than 10 times the original volume of the non-bubbled coating liquid;

coating a surface of a substrate sheet with the bubbled coating liquid; and drying the coated bubbled coating liquid layer to provide an ink-receiving porous polymer coating layer.

DESCRIPTION OF THE PREFERRED EMBODIMENTS

The inventors of the present invention made intensive studies to solve the above-mentioned problems and found that the problems can be solved by forming an ink-receiving porous polymer layer comprising a polymeric material, and having a plurality of fine pores on a surface of a substrate sheet, controlling the size of the pores distributed in a surface portion of the ink-receiving layer and the apparent density of the ink-receiving layer into specific ranges, and further controlling the thermal conductivity of the laminate of the substrate with the ink-receiving layer determined by the laser flash method into a specific range. Also, it is found that the ink-receiving porous polymer layer preferably exhibits a specific stress under a specific compression in the direction of thickness of the ink-receiving layer.

The present invention was completed on the basis of the above-mentioned findings.

In the present invention, a coating liquid for forming an ink-receiving porous polymer layer is prepared from a polymeric material which may be in the state of a solution dispersion or emulsion (latex), and then mechanically agitated to an extent such that a large number of fine air bubbles independent from each other are introduced in an average size of 0.5 to 30 μm into the coating liquid, and the resultant bubbled coating liquid has a total volume larger than but not more than 10 times the original volume of the non-bubbled coating liquid; the resultant bubbled coating liquid is coated on a surface of the substrate sheet and then dried to form an ink-receiving porous resinous coating layer. The resultant ink-receiving porous polymer coating layer must be provided with a plurality of pores in which those distributed in the surface portion of the ink-receiving layer have an average size of 0.5 to 30 μm, and have an apparent density of 0.05 to 0.5 g/cm$^3$. Also, the laminate of the substrate sheet with the ink-receiving porous polymer coating layer must have a thermal conductivity of 0.25 W/(m.K) or less, determined by the laser flash method. Preferably, the ink-receiving porous resinous coating layer exhibits a stress of 10 kg/cm$^2$ or less under a compression of 10% by volume in the direction of thickness of the ink-receiving layer.

The hot melt ink thermal transfer recording sheet of the present invention has an enhanced dot reproducibility, an excellent continuous tone reproducibility and a superior colored image brightness in comparison with those of prior arts.

In the hot melt ink thermal transfer recording sheet of the present invention, the ink-receiving porous polymer coating layer usually comprises, as a principal component, a polymeric material or a mixture of a polymeric material with a pigment. The ink-receiving porous polymer coating layer can be formed by coating liquid containing the polymeric material or the polymeric material-pigment mixture and bubbled by a mechanical agitation to the extent as mentioned above, on a surface of the substrate sheet and drying the bubbled coating liquid layer.

The polymeric material for the ink-receiving porous resinous coating layer is preferably selected from water-soluble polymeric materials, for example, various polyvinyl alcohols different in molecular weight and degree of saponification from each other and derivatives thereof, starch, starch derivatives, for example, oxidized starch, cation-modified starch, cellulose derivatives, for example, methoxycellulose, carboxy-methylcellulose, methylcellulose and ethylcellulose, polyacrylic acid sodium salt, polyvinylpyrrolidone, acrylic acid amide-acrylic ester copolymers, acrylic acid amide-acrylic ester-methacrylic ester-copolymers, alkali metal salts of styrene-maleic anhydride copolymers, polyacrylic amide and derivatives thereof and polyethylene glycol; water-insoluble polymeric materials, for example, polyvinyl acetate, polyurethane, styrene-butadiene copolymers, acrylonitrile-butadiene copolymers, polyacrylic esters, vinyl chloride-vinyl acetate copolymers, polybutylmethacrylate, ethylene-vinyl acetate copolymers, styrene-butadiene-acrylic compound-copolymers, nitrile compound-butadiene copolymers, and polyvinylidene chloride, which are in the state of a solution, dispersion or emulsion (latex); and another natural polymeric materials, for example, glue, casein, soybean protein, gelatin and sodium alginate. These polymeric materials can be employed alone or in a mixture of two or more thereof.

The pigment usable for the ink-receiving porous polymer coating layer are not limited to specific materials. Nevertheless, the pigment is preferably selected from inorganic pigments, for example, zinc oxide, titanium dioxide, calcium carbonate, silicic acid, silicates, clay, talc, mica, calcined clay, aluminum hydroxide, barium sulfate, lithophone (zinc baryta white), and colloidal silica, organic synthetic pigments, for example, polystyrene, polyethylene, polypropylene, epoxy resins, styrene-acrylic compound copolymers, which are in the form of fine spheres or hollow particles or another shaped form, and natural organic pigments, for example, starch, and cellulose particles. Those pigments may be employed alone or in a mixture of two or more thereof.

To obtain an ink-receiving porous polymer coating layer capable of receiving thermally transferred hot melt ink images having good quality, the pigment is preferably employed in an amount of 0 to 900 parts by weight per 100 parts by weight of the film-forming polymer. If the amount of the pigment is too large, the resultant ink-receiving layer may have an unsatisfactory mechanical strength and thus the ink-receiving layer may be separated from the substrate sheet during the thermal transfer procedure of the hot melt ink images or the transferred images may be defective and unclear.

In the preparation of the coating liquid for the ink-receiving layer, a conventional additive, for example, a viscosity modifier, dispersing agent, coloring material (dye), water-resisting agent, lubricant, cross-linking agent or plasticizer, may be added before the bubbling procedure.

The ink-receiving porous polymer coating layer is formed preferably in a dry amount of 2 to 40 g/m$^2$ on the substrate sheet surface. When the coating amount is less than 2 g/m$^2$, it may be difficult to fully cover the rough surface of the substrate sheet with the ink-receiving layer having satisfactory smooth surface, heat-insulating property and compression-deforming property. If the coating amount is more than 40 g/m$^2$, the resultant ink-receiving layer may have too a large thickness and a poor bonding strength, and may be separated from the substrate sheet during the thermal transfer procedure, and thus it may be difficult to obtain hot melt ink images transferred to the ink-receiving layer and having good quality. Accordingly, the coating amount of the ink-receiving receiving layer should be carefully controlled, together with the composition of the coating liquid.

As mentioned above, the ink-receiving porous polymer coating layer is formed by coating a surface of a substrate sheet with a coating liquid containing a film-forming polymer and optionally a pigment and provided with a large number of air bubbles introduced therein by mechanically agitating the coating liquid, and drying the coating liquid layer. The agitating method and apparatus and coating method and device are not limited to specific ones. The agitating procedure is carried out to an extent such that the total volume of the bubbled coating liquid becomes larger than but not more than 10 times, preferably 5 times or less, the original volume of the non-bubbled coating liquid. The ratio in volume of the non-bubbled coating liquid to the bubbled coating liquid will be referred to as a bubbling ratio hereinafter.

The higher the bubbling ratio, the larger the total content of pores in the resultant ink-receiving layer. Also, the higher the bubbling ratio, the smaller the thickness of walls surrounding the pores. In a fixed content of the solid components in the ink-receiving layer, the lower the total content of the solid components in the ink-receiving layer, the smaller the thickness of the walls surrounding the pores. The small thickness of the walls surrounding the pores results in a low mechanical strength of the ink-receiving layer. Accordingly, the bubbling ratio and the composition and the solid content of the coating liquid should be carefully controlled and well balanced.

The mechanism of the improvement of the thermally transferred hot melt ink image-receiving performance of the ink-receiving layer of the present invention is considered to be closely related to physical properties, for example, the structural performances, heat-insulating properties and compression performances, of the ink-receiving porous polymer coating layer and the recording sheet. With respect to the structural performances, since a large number of fine pores are distributed in the surface portion of the ink-receiving layer and the pores are connected to each other and to the outside atmosphere through a plurality of capillaries, and thus can absorb the hot melt ink in the pores through the capillaries, the hot melt ink can easily penetrate into and can be received in the ink-receiving layer. Therefore, the ink-receiving porous polymer coating layer of the present invention exhibits a high receiving capacity to the hot melt ink.

In connection with the ink-receiving capacity, the size of the pores distributed in the surface portion of the ink-receiving layer is very important. Namely, to form good images on the recording sheet surface of the present invention, the pores distributed in the surface portion of the ink-receiving layer must have an average size of 0.5 to 30 μm, preferably 0.5 to 20 μm at which the quality of the hot melt ink images received in the ink-receiving layer becomes better. The size of the pores closely relates to the capacity of the ink-receiving layer for catching (receiving) the hot melt ink by a capillary phenomenon. The larger the size of the pores, the higher the ink-receiving capacity. However, if the pore size is too large, the ink may be embedded in the pores, the close contact of the ink-receiving layer surface with the ink ribbon surface may be obstructed so that the ink cannot be fully transferred from the ink ribbon to the ink-receiving layer and the transferred ink images may have a reduced evenness or a low dot reproducibility and thus may be unclear. The average size of the pores in the ink-receiving layer can be measured and determined by using an optical microscopic photograph or a scanning electron microscopic photograph and an image-analyzing apparatus.

The size of the pores in the ink-receiving layer may be influenced by various conditions, for example, the composition of the coating liquid before the bubble-formation and dispersion treatment, the type of the component materials, the mixing ratio of the components, the content of the solid components by which the ink-receiving layer is formed after the bubbling, coating and drying procedures, the bubbling ratio, and coating method. Therefore, the above-mentioned conditions must be appropriately controlled. Further, the size of the pores distributed in the surface portion of the ink-receiving layer closely relates to the size of the air bubbles introduced into the coating liquid by the mechanical agitation and, generally, the smaller the size of the air bubbles in the coating liquid, the smaller the size of the pores formed in the ink-receiving layer after the coating and drying procedures. Accordingly, in the preparation of the bubbled coating liquid, the size of the air bubbles is controlled to the same size as the target size of the pores in the ink-receiving layer, namely, an average size of from 0.5 to 30 μm, preferably from 0.5 to 20 μm. The size of the air bubbles in the coating liquid can be measured and determined by an optical microscopic photograph of the bubbled coating liquid and an image analyzing apparatus.

The heat-insulating property is also an important physical property of the recording sheet. Namely, in the hot melt ink thermal transfer recording operation, a hot melt ink ribbon is heated imagewise with a thermal head to melt the ink imagewise and the melted ink is transferred to the ink-receiving layer of the recording sheet. Therefore, if the heat-insulating property of the recording sheet is too low (in other word, if the thermal conductivity of the recording sheet is too high), the temperature of the interface portion between the ink ribbon and the recording sheet brought into contact with the ink ribbon cannot be satisfactorily raised, the melted ink is easily solidified, and thus it is difficult to transfer the ink imagewise to the ink-receiving layer. Namely, the high thermal conductivity results in a low thermal transfer recording property of the recording sheet. Accordingly, the laminate of the ink-receiving layer with the substrate sheet must have an appropriate thermal conductivity. The thermal conductivity of the laminate must be controlled to a level of 0.25 W/(m.K) or less, determined by the laser flash method.

The thermal conductivity by the laser flash method can be determined by using a laser flash tester, for example, available under the trademark of LF/TCM (FA 8510B type) from Rigaku Denki K. K.

In the laser flash test, a ruby laser beam is irradiated to a front surface of a specimen, and the raise in temperature on the back surface of the specimen was detected and recorded until reaching a peak. A time t½ in seconds from the start of the radiation to a stage at which the temperature reached a level of ½ of the peak temperature is measured.

A heat diffusion coefficient α in $cm^2$/sec of the specimen is calculated in accordance with the following equation.

$$\alpha=0.1388\times L^2/t_{1/2}$$

wherein L represents a thickness in cm of the specimen. Also, a specific heat Cp in J/(g.K) of the specimen is measured by the laser flash method, and the density ρ ($g/cm^2$) of the specimen is determined from the basis weight and the thickness of the specimen. The thermal conductivity λ in W/(m.K) of the specimen is calculated from the specific heat Cp, the density ρ and the heat diffusion coefficient α of the specimen in accordance with the following equation.

$$\lambda=1.0\times10^2\times\alpha\times Cp\times\rho$$

The specific heat α of the specimen may be an average specific heat in J/(g.K) of the specimen calculated from the values of the specific heat of the substrate sheet and the ink-receiving porous polymer coating layer of the specimen by a weighted mean method.

The heat insulating property of the ink-receiving porous polymer coating layer is an important physical property, together with the total heat insulating property of the recording sheet. It is desirable to measure and evaluate the heat-insulating property of the ink-receiving layer per se. However, the isolation of the ink-receiving layer from the substrate sheet is very difficult, and thus the measurement and evaluation of the heat-insulating property of the ink-receiving layer per se is practically impossible. Generally, the heat-insulating property of a porous structure closely relates to the density of the porous structure. Namely, the lower the density, the higher the heat-insulating property of the porous structure. Accordingly, a good hot melt ink thermal transfer recording performance of the recording sheet can be obtained by controlling the total thermal conductivity of the recording sheet to 0.25 W/(m.K) or less determined by the laser flash method and further controlling the apparent density of the ink-receiving porous polymer coating layer to a range of from 1.05 to 0.5 g/cm$^3$.

The apparent density of the ink-receiving layer closely relates to a bubbling ratio in the preparation of the bubbled coating liquid. The higher the bubbling ratio, namely, the larger the total amounts of the air bubbles contained in the bubbled coating liquid, the higher the heat-insulating property of the resultant ink-receiving layer. Also, the apparent density closely relates to the concentration of the solid components in the coating liquid before the mechanical agitation. When two types of bubbled coating liquids which are the same in the bubbling ratio as each other and different in the solid concentration from each other, are coated in the same coating amount in dry weight, and the resultant coated coating liquid layers are dried under the same drying conditions as each other, a difference in shrinkage conditions between the resultant ink-receiving porous polymer coating layers is generated due to a evaporation of water from the bubbled coating liquid layers. When the solid concentration is lower than the other, the shrinkage of the resultant bubbled coating layer during the drying procedure is larger than the other, even when the dry weight of the bubbled coating liquid layer is the same as the other. Accordingly the resultant dry ink-receiving layer is thinner than the other. Therefore, the apparent density of the ink-receiving layer should be controlled in consideration of not only the bubbling ratio but also the solid concentration of the coating liquid.

In the thermal transfer procedure, since the ink-receiving layer of the recording sheet is brought into close contact with the ink layer of the ink ribbon under a compression pressure, so as to transfer the ink from the ink ribbon to the ink-receiving layer, it is assumed that the compression-deformability of the ink-receiving layer is an important factor for enhancing the cross contact of the ink layer with the ink-receiving layer. Therefore, in addition to the apparent density, the compression performance of the ink-receiving layer formed on the substrate sheet is also important. The compression performance can be represented by a stress generated on the ink-receiving layer under compression of 10% by volume in the direction of thickness of the ink-receiving layer. The lower the compression stress of the ink-receiving layer, the higher the softness of the ink-receiving layer and thus the higher the degree of close contact of the ink-receiving layer with the ink ribbon. To enhance the close contact, the stress of the ink-receiving layer under a compression of 10% by volume in the direction of thickness thereof is preferably controlled to 10 kg/cm$^2$ or less.

In the present invention, the method of introducing and dispersing air bubbles in the polymeric material-containing coating liquid, which will be referred to as a bubbling method, can be carried out by using a whipping machine for confectionery having agitating wings rotating in a planetary movement; an agitator, for example, a homo-mixer which is usually utilized for emulsifying and dispersing, and a Caures dissolver; and an apparatus capable of mechanically agitating a mixture of air with a polymeric material-containing liquid in a closed system while continuously feeding the mixture into the closed system so as to finely divide the air bubbles and disperse the fine air bubbles in the polymeric material-containing liquid, for example, a continuous whipping machine made by Guston County Co, U.S.A. or Stok Co, Netherland. However, the agitating machine usable for the present invention is not limited to the above-mentioned machines and apparatus.

When the mechanical agitating apparatus has an insufficient capacity for bubbling the polymeric material-containing coating liquid to a desired extent, or for the purpose of enhancing the stability of the bubbles introduced into the polymeric material-containing coating liquid, an additive selected from various materials having a surface-activating effect, for example, foam (bubble)-stabilizers and foaming agents may be added to the polymeric material-containing coating liquid to be bubbled.

The materials having the surface-activating effect may be selected from higher fatty acid, modified higher fatty acids and alkali metal salts of higher fatty acids, and amine salts of higher fatty acids, which has an excellent activity for enhancing the foaming property of the polymeric material-containing coating liquid and a superior stabilizing effect of the bubbles dispersed in the polymeric material-containing coating liquid. These surface active agents are not limited to a specific class of compounds, unless they cause the fluidity and coating property of the resultant polymer-containing coating liquid to significantly decrease. More particularly, the surface active agent preferably comprises at least one member selected from surface active compounds having at least one hydrophobic group having a carbon atom chain, for example, higher fatty acid salts, higher alkyl dicarbocyclic acid salts, monohydric and dihydric higher alcohol sulfonate ester acids and higher alkylsulfonic acid salts, higher alkyl disulfonic acid salts, sulfonated higher fatty acids, and higher alkyl phosphoric acid ester salts; other surface active compounds having at least one hydrophobic group comprising a chain group comprising carbon atoms and another element atoms, for example, sulfuric acid ester salts of higher fatty acid esters, sulfonic acid salts of higher fatty acid esters, alkylated sulfonic acid salts of higher fatty acid amides, sulfosuccinic acid ester salts, alkylated phosphoric acid salts of higher fatty acid amides, sulfonic acid salts of higher alcohol ethers and condensation products of higher fatty acids with amino acids; still other surface active compounds having at least one hydrophobic cyclic structure consisting of only carbon atoms, for example, alkylbenzenesulfonic acid salts, alkylphenolsulfonic acid salts and sulfonic acid salts having an alkyldiphenyl ring; still other surface active compounds having at least one hydrophobic ring comprising carbon atoms and another element atoms, for example, alkylbenzoimidazole sulfonic acid salts; polycyclic surface active compounds having a hydrophobic group derived from a natural material, for example, naphtheric acid salts, ligninsulfonic acid salts and resin acid salts; aliphatic amine salt surface active compounds, for example, aliphatic primary, secondary and tertiary amine salts; quaternary ammonium salt surface active compounds, for example, alkyl quaternary ammonium salts and quaternary ammonium salt compound having a nitrogen-containing ring structure; sulfonium salt and arsonium salt surface active compounds; betain type, glycine type, aranime type and sulfobetaine type ampholytic surface active compounds; polyoxy compound-fatty acid ester type surface active compounds, for example, glycerol esters of higher fatty acids and glycol esters of fatty acids; polyethylene oxide condensation type surface active compounds, for example, condensation products of higher alcohols, higher fatty acid-condensation products, higher fatty acid amide-condensation products; and polypropylene condensation type surface active compounds.

The surface active agent, for example, the foam (bubble) stabilizer and foaming agent, is preferably used in an amount of 30 parts of dry weight or less, more preferably 1 to 20 parts by weight per 100 parts by dry weight of the polymer-containing coating liquid which optionally further contains a pigment. Even if the surface active agent is added in an amount of more than 30 parts by dry weight, the addition effect thereof is saturated and an economical disadvantage occurs.

In the formation of the ink-receiving porous layer in the process of the present invention, the bubbled coating liquid is coated on a surface of a substrate sheet by a conventional coating method such as a mayor bar, gravure roll, roll, reverse roll, blade, knife, air-knife, extrusion or cast coating method.

The coated bubbled coating liquid layer is dried by a conventional drying method, for example, a hot air, infrared (IR), steam cylinder or microwave drying method.

The recording sheet of the present invention made by the above-mentioned coating procedure of the bubbled coating liquid on the substrate sheet and the drying procedure exhibits a satisfactory hot melt ink image-receiving property. The smoothness of the ink-receiving porous layer can be enhanced by applying a calender-finishing procedure to the ink-receiving porous layer surface by using a machine calender having at least two metal rollers, or a super calender having a combination of a metal roller with a resinous roller or with a cotton roller. The surface smoothness of the ink-receiving porous polymer coating layer can be enhanced by bringing the coated bubbled coating liquid layer surface in a semi-dried condition or a dried condition into contact with a mirror-finished casting surface of a casting base, for example, a casting drum, under a heated or non-heated condition. However, if the smoothing procedure is carried out under too a high pressure, the polymeric walls surrounding the individual air bubbles may be broken and the ink-receiving porous layer is made dense so that the resultant ink-receiving layer exhibits decreased heat-insulating property and cushioning property. Also, since the pores located in the surface portion of the ink-receiving layer are deformed or broken, the hot melt ink-receiving capacity may be decreased. Accordingly, the surface-smoothing procedure and the treatment conditions must be carefully established.

In the hot melt ink thermal transfer recording sheet of the present invention, the substrate sheet can be formed from, for example, paper sheets comprising as a principal component, cellulose, coated paper sheets, laminate paper sheets, fabrics, for example, woven fabrics and nonwoven fabrics, plastic films for example, polyolefin film, polymethacylate ester films, and cellulose acetate films, synthetic paper sheet comprising a polyolefin resin and a pigment, and porous synthetic polymer films, for example, foamed polyethylene terephthalate films and foamed polypropylene films.

Among the substrate sheets formed from the above-mentioned materials, the substrate sheet having a high heat-insulating property can cause the resultant recording sheet to exhibit higher dot-reproducibility, continuous tone-reproducibility and color brightness of images than those of the recording sheet comprising a substrate sheet having a low heat-insulating property, even when the heat energies applied are the same.

Also, the high heat-insulating substrate sheet can cause the ink images formed on the resultant recording sheet to exhibit an enhanced color density. The energy consumption necessary to obtain a desired color density and recording quality of the ink images on the recording sheet having the high heat-insulating substrate sheet is lower than that of the comparative recording sheet having the low heat-insulating substrate sheet. Therefore, the high heat insulating substrate sheet can also effectively save the energy consumption.

Further, the substrate sheet consisting of a paper sheet or a coated paper sheet comprising cellulose pulp as a principal component is advantageous in that the sheet can be recycled and reused.

In the production of the recording sheet of the present invention by coating a bubbled polymer-containing coating liquid on a surface of a substrate sheet, drying the coated liquid layer, and winding the dried sheet, the resultant sheet may be curled inward on the coated surface or opposite surface to the coated surface thereof. When the curled recording sheet is cut into desired dimensions and the resultant cut recording sheets are fed to a hot melt ink thermal transfer printing machine, the fed recording sheets may not smoothly travel in the printing machine, and sometimes the travelling passage of the recording sheets are blocked by a curled sheet. Alternatively, since the heating means, for example, a thermal head, is brought into contact with an ink ribbon which has been brought into contact with a recording sheet, to transfer the ink from the ink ribbon to the recording sheet, the recording sheet may be curled due to a difference in shrinkage or expansion between the ink-receiving porous polymer coating layer and the substrate sheet, and the curled recording sheets cause the above-mentioned troubles in the printing machine. Namely, when the curling occurs on the recording sheets, the ink images may be irregularly transferred to the recording sheet at an inclined angle to the longitudinal direction of the recording sheets, and the sheets are wrinkled in the printing machine so that the sheets cannot be smoothly and regularly brought into regular intact with the ink ribbon and thus the recorded ink images on the recording sheet are defective and irregular and have a poor image quality.

To prevent trouble occurring in the printing machine due to the curling of the recording sheet, it is desirable to make the difference in shrinkage or expansion between the ink-receiving porous layer and the substrate sheet as small as possible. For this purpose, a curl-preventing layer may be coated or laminated on a surface of the substrate sheet opposite to the ink-receiving porous layer. There is no limitation to the type of material, forming method and coating or laminating amount of the curl-preventing layer. The curl-preventing layer, however, has to be designed in consideration of the type and thickness of the substrate sheet, and the properties, for example, the composition, the bubbling ratio and the coating amount, of the ink-receiving porous layer.

When the substrate sheet is made from a certain type of sheet material, the resultant recording sheets may be charged with static electricity in the printing machine through which the recording sheets travel under inevitable friction with each other and with parts of the printing machine and/or in which the recording sheets are exposed to a reduced humidity. Under the above-mentioned conditions, when the recording sheets are continuously subjected to the hot melt ink image-thermal transfer procedure, the individual recording sheets adhere with the adjacent sheets due to the static charge and are difficult to separate from each other. Particularly, the substrate sheets comprising plastic sheets or synthetic paper sheets which are inherently easily charged with static electricity are easily charged during cutting procedure or storage, and thus the cut substatic sheets are sometimes difficult to smoothly separate from each other. To prevent the static problems, the anti-static layer may be formed on the back surface of the substrate sheet. Also, the static problems can be solved by adding an anti-static material to the substrate sheet and/or the ink-receiving porous layer, or by reducing the friction between the ink-receiving porous layer surface and the back surface of the recording sheet. Accordingly, the anti-static layer can be formed by a material selected from various anti-static and/or low friction materials and a method selected from various anti-static property-enhancing and/or friction-reducing methods.

The above-mentioned curl-preventing layer and the anti-static layer may be formed individually on the back surface side of the substrate sheet, to attain the target performances. However, to simplify the recording sheet-producing process, reduce the production cost of the recording sheet, and attain the target performances, the single layer having both the anti-static property and curl-preventing property can be formed on the back surface of the substrate sheet. In the formation of the single anti-static and curl-preventing layer, the layer-forming material and method should be carefully selected and designed. There is no limitation to the number of the functional coating layers formed on the back surface of the substrate sheet.

In the hot melt ink thermal transfer recording sheet of the present invention, when a prism surface is brought into contact with the ink-receiving porous polymer coating layer under a pressure of 2 kg/cm$^2$ an optical contact of the ink-receiving layer with the prism surface is preferably 6% or more. More preferably, the optical contact of the ink-receiving porous polymer coating layer with the prism surface is 6 to 65% under a pressure of 2 kg/cm$^2$.

Also, in the process of the present invention, the formation of the ink-receiving porous polymer coating layer is preferably controlled so that when a prism surface is brought into contact with the resultant ink-receiving layer under a pressure of 2 kg/cm$^2$, an optical contact of the ink-receiving layer with the prism surface is 6% or more, more preferably 6 to 65%.

As mentioned above, when a cross-section of the ink-receiving porous polymer coating layer of the present invention is observed by a scanning electron microscope, a plurality of pores are separated from each other through solid polymer walls surrounding the pores, and are connected to each other through a plurality of capillaries formed in the solid polymer walls due to the specific structure consisting of combinations of the plurality of pores with the plurality of capillaries, the hot melt ink transferred from the ink ribbon can be easily caught by the pores located in the surface portion of the ink-receiving layer and penetrate into the pores located inside of the ink-receiving layer and fixed in the pores. Therefore, the ink-receiving porous polymer coating layer of the present invention exhibits a high hot melt ink-receiving capacity.

In the recording sheet of the present invention, it is important that the ink-receiving porous polymer coating layer surface has an appropriate roughness. When the hot melt ink is transferred from the ink ribbon, the ink-receiving layer surface of the recording sheet is brought into contact with the hot melt ink layer of the ink ribbon while the recording sheet is pressed at the back surface thereof with a platen roll toward the ink ribbon. Also, the ink ribbon is heated imagewise at the back surface thereof by a thermal head so that portions of the ink is melted imagewise and then transferred to the ink-receiving layer surface of the recording sheet. Therefore, the roughness of the ink-receiving layer surface influences on the close contact of the ink-receiving layer and the ink layer and thus on the quality of the transferred ink images.

Generally, the surface smoothness of a sheet material is represented by the time in seconds necessary to pass a predetermined amount of air through a surface to be tested. The higher the surface smoothness, the lower the necessary time. The surface smoothness can be measured by Ohken smoothness tester which is of an air leak type. As mentioned above, however, the pores located in the surface portion and inside of the ink-receiving layer are connected to each other through a plurality of capilies, and thus the air blown toward the surface can permeate not only through the surface portion, but also through the inside portion of the ink-receiving layer. Therefore, the smoothness of the ink-receiving porous polymer coating layer of the present invention cannot be correctly measured by the conventional air-flow method.

In another conventional method for measuring the smoothness of the sheet material, a laser beam or white light is irradiated to a surface of a specimen to scan the specimen surface. This is a non-touch type surface roughness tester.

In the recording sheet of the present invention, however, the hot melt ink is thermally transferred to the ink receiving layer surface under pressure, the above-mentioned conventional roughness tester is not suitable to measure the smoothness of the ink-receiving layer under practically pressed conditions.

Therefore, the smoothness of the ink-receiving layer surface should be measured under the same pressure as that applied to the ink-receiving layer when practically printed. For example, the smoothness of the ink receiving layer of the present invention can be represented by an optical contact of the receiving layer with a prism surface pressed toward the ink-receiving layer surface under a pressure of 2 kg/cm$^2$ or more, by using Microtopograph (trademark, made by Toyo Seiki Seisakusho). The optical contact measured by the Microtopograph will be explained in detail below.

A surface of a sheet material to be tested is brought into contact with a surface of a prism under pressure, a light is irradiate at an angle of 45 degrees to the sheet surface through the prism. The light is reflected at an interface between the media different in refractive index from each other. The location of the reflecting interface varies depending on the wavelength of the light. Generally, the shorter the wavelength, the smaller the depth from the sheet surface to the reflecting interface. In the Microtopograph, the above-mentioned refection property of the light is utilized, and an optical contact in percent of the sheet surface with a prism surface under a predetermined pressure is determined from a proportion of the reflected light volume to the incident light volume. The larger the optical contact, the higher the smoothness of the sheet surface under pressure.

In the recording sheet of the present invention, the smoothness of the ink-receiving porous polymer coating layer is preferably controlled to an optical contact of 6% or more, more preferably 6 to 65%, with a prism surface under a pressure of 2 kg/cm$^2$. The resultant ink-receiving layer can then record hot melt ink images having high color density, dot-reproducibility, continuous tone-reproducibility and color brightness.

In the measurement of the optical contact, usually the wavelength of the incident light is 0.5, 0.9, 1.3 or 1.7 μm. The wavelength is not limited to those mentioned above. However, the contact of the sheet surface with the prism surface must be made under a pressure of 2 kg/cm$^2$.

In the preparation of the bubbled coating liquid, the non-bubbled coating liquid preferably has a viscosity of 5,000 to 100,000 cP, more preferably 10,000 to 50,000 cP, determined by the Brookfield type viscometer at a temperature of 23° C. If the viscosity of the coating liquid before agitation is less than 5,000 cP, the resultant fine air bubbles introduced into the coating liquid have a poor stability for storage and thus are easily broken or incorporated to each other. Therefore, the bubbled coating liquid cannot form a satisfactory ink-receiving porous polymer coating layer having a fine pores, and the resultant ink-receiving layer exhibits unsatisfactory ink image-receiving property. Generally, the higher the viscosity, the higher the stability of fine air bubbles introduced into the coating liquid. However, if the viscosity is more than 100,000 cP, the bubbled coating liquid exhibits a viscosity higher than that of the non-bubbled coating liquid and thus a degraded coating property. Namely, the bubbled coating liquid having too a high viscosity is difficult to evenly coat on the substrate sheet, and thus the resultant ink-receiving porous polymer coating layer may be uneven. Further, the coating liquid having too a high viscosity may need too a large energy for the agitation, and thus the production of the recording sheet may be costly.

The viscosity of the coating liquid can be controlled by conventional means, for example, adding a viscosity-controlling agent, for example, carboxymethyl celluloses and derivatives different in molecular weight from each other, modified polyacrylic acid, sodium alginate and maleic anhydride copolymers.

In an embodiment of the recording sheet of the present invention, the ink-receiving porous polymer coating layer is formed from an aqueous liquid containing a polyurethane resin.

The polyurethane resin preferably has a 100% modulus of elasticity of 50 to 400 kg/cm$^2$ determined in accordance with Japanese Industrial Standard (JIS K 6301).

The aqueous polyurethane dispersion is preferably prepared by polyaddition of a polyisocyanate component with a polyol component comprising a high molecular weight polyol compound and a low molecular weight polyol compound having at least one member selected from carboxyl and sulfonic groups, in a reaction medium which is inert to the polyaddition reaction and soluble in water, and dissolving the reaction product mixture in water.

Preferably, the lower molecular weight polyol compound having at least one member selected from carboxyl and sulfonic groups is employed in an amount of 0.5 to 50% by weight based on the total weight of the polyisocyanate component and the polyol component.

The polyaddition of the polyisocyanate component with the polyol component can be carried out in a single step or in two steps in which portions of the polyisocyanate and polyol components are pre-reacted with each other, and then the resultant pre-polymer is reacted with the remaining portions of the polyisocyanate and polyol components.

The polyisocyanate component comprises at least one compound selected from aliphatic, cycloaliphatic and aromatic polyisocyanate compounds, for example, 2,4-tolylene diisocyanate, 2,6-tolylene diisocyanate, 4,4-diphenylmethane diisocyanate, phenylene diisocyanate, xylylene diisocyanate, tetramethylxylylene diisocyanate, tetramethylene diisocyanate, hexamethylene diisocyanate, lysine diisocyanate ester, 1,4-cyclohexylylene diisocyanate, 4,4'-dicyclohexylmethane diisocyanate, 3,3'-dimethoxy -4,4'-biphenylene diisocyanate, 1,5-naphthalene diisocyanate, 1,5-tetrahydronaphthalene diisocyanate and isophorone diisocyanate.

In the preparation of the polyurethane resin, the polyisocyanate component reacts with the polyol component and optionally a chain extender.

The polyisocyanate component is preferably employed in an amount of 0.3 to 3 times, more preferably 1 to 2 times the total equivalent weight of active hydrogen atoms of the high molecular weight polyol compound, the low molecular weight polyol compound having the carboxyl and/or sulfonyl group and optionally the chain extender. If the amount of the polyisocyanate component is less than 0.8 times the total equivalent weight of the polyol component and optionally the chain extender, the resultant reaction product mixture contains a certain amount of non-reacted polyol component, if the amount of the polyisocyanate component is more than 3.0 times the total equivalent weight of the polyol component and the chain extender, and the resultant reaction product is added with water, the resultant compound contains a urea structure in a large amount; and in either case, the resultant polyurethane resin aqueous dispersion exhibits a degraded performance.

The high molecular weight polyol usable for producing the aqueous polyurethane resin dispersion, is preferably selected from addition reaction products of low molecular weight polyol compounds, for example, ethylene glycol, diethyleneglycol, tolyleneglycol, 1,2-propyleneglycol, 1,3-propyleneglycol, 1,2-butyleneglycol, 1,3-butyleneglycol, 1,4-butyleneglycol, neopentylglycol, 1,6-hexanediol, hydrogenated bisphenol A and hydroxyalkoxybisphenol A, with ethylene oxide and/or propylene oxide; polyether polyols, for example, polyethleneglycol, polypropyleneglycol, polyethylene/propylene glycol copolymers and polytetraethyleneglycol; condensation reaction products of low molecular weight polyols with polycarboxylic acids or carbonic acid, for example, succinic acid, glutaric acid adipic acid, sebacic acid, phthalic acid, isophthalic acid, terephthalic acid, tetrahydrophthalic acid, endomethylenetetrahydrophthalic acid and hexahydrophthalic acid, i.e., polyesterpolyols, polycarbonates and polycaprolactone.

The low molecular weight polyols having at least one member selected from carboxyl and sulfonic groups, and usable for the present invention are preferably selected from 2,2-dimethylol propionic acid, 2,2-dimethylol butyric acid, 2,2-dimethylol valeric acid and 1,4-butanediol-2 sulfonic acid. Especially, the low molecular weight polyols having a carboxyl group, for example, 2,2-dimethylol propionic acid, 2,2-dimethylol butyric acid and 2,2-dimethylol valeric acid are used, the resultant aqueous polyurethane resin dispersion has an excellent dispersion stability.

The low molecular weight polyol having the carboxyl and/or sulfonic group is preferably employed in an amount of 0.5 to 50% by weight, more preferably 1 to 30% by weight, based on the total weight of all the components used for forming the polyurethane resin. The using amount of the low molecular weight polyol is established in consideration of the types and amounts of the high molecular weight polyol and the polyisocyanate component. If the amount of the low molecular weight polyol is less than 0.5% by weight, the resultant aqueous polyurethane resin dispersion may have an unsatisfactory stability in storage. Also, if the amount of the low molecular weight polyol is more than 50% by weight, the resultant polyurethane resin may exhibit unsatisfactory physical properties, for example, a low flexibility and/or a low ultimate elongation.

In the preparation of the aqueous polyurethane resin dispersion, the polyaddition of the polyisocyanate component with the polyol component and optionally the chain extender, is carried out in a reaction medium which is inert to the polyaddition reaction and is soluble in water. The water-soluble reaction medium preferably comprises at least one member selected from the group consisting of acetone, methylethyl ketone, dioxane, tetrahydrofuran, and N-methyl-2-pyrrolidone.

The reaction medium is employed preferably in an amount of 10 to 100% by weight based on the total weight of all the reaction components for the polyurethane resin.

In the preparation of the aqueous polyurethane resin dispersion, the reaction mixture may be neutralized with a neutralizing agent comprising at least one member selected from organic amine compounds, for example, trimethylamine, triethylamine, tripropyl amine, tributyl amine, N-methyl diethanolamine and triethanolamine, and inorganic basic compounds, for example, sodium hydroxide, potassium hydroxide and ammonia. The neutralizing agent is employed in an amount sufficient to neutralize the carboxyl and/or sulfonic groups of the low molecular weight polyol component.

The chain extender which is optionally employed in the preparation of the polyurethane resin, preferably comprises at least one member selected from low molecular weight polyols, for example, ethyleneglycol, 1,2-propyleneglycol, 1,4-butyleneglycol, neopentylglycol, 1,6-hexanediol, trimethylolpropane, and pentaerythritol; amine compounds, for example, ethylenediamine, propylene diamine, hexamethylenediamine, tolylenediamine, xylylenediamine, diamimodiphenylmethane, diaminocyclohexylmethane, piperazine, 2-methylpiperazine, isophoronediamine, melamine and succinic acid dihydrazide, adipic acid dihydrazide and phthalic acid dihydrazide; and water.

The amount of the chain extender to be employed is variable and depends on the desired molecular weight of the polyurethane resin. It is usually in the range of from 0.5 to 10% by weight based on the total weight of all the reaction components.

The preparation of the aqueous polyurethane resin dispersion can be effected by a conventional method in which the addition of the reaction components may be carried out in any sequence and the polyaddition reaction may be carried out in a single step or two or more steps. The solid content of the polyurethane resin in the reaction product mixture is controlled preferably to 1 to 90% by weight, more preferably 5 to 80% by weight.

The polyurethane resin usable for the present invention is not limited to those having specific performances as long as the polyurethane resin is hydrophilic. Usually, the polyurethane resin preferably exhibits a tensile strength of 200 to 800 kg/cm$^2$, an ultimate elongation of 100 to 1000%, and a 100% modulus of elasticity of 50 to 400 kg/cm$^2$, more preferably 70 to 350 kg/cm$^2$. The tensile strength, ultimate elongation and 100% modulus of elasticity are determined in accordance with JIS K 6301.

In the recording sheet of the present invention, the 100% modulus of elasticity of the polyurethane resin for the ink-receiving porous polymer coating layer is preferably controlled to 50 to 400 kg/cm$^2$. When the 100% modulus of elasticity of the polyurethane resin is in the range of from 50 to 400 kg/cm$^2$, the resultant recording sheet exhibits an enhanced resistance to blocking during storage thereof, and an improved reproducibility of the received ink images. The polyurethane resin having a 100% modulus of elasticity of 50 to 400 kg/cm$^2$ can be prepared (1) by using a chain extender comprising a three or more functional low molecular weight polyol or polyamine; (2) by appropriately controlling a content of hard segment structures in the polyurethane resin molecules by controlling a proportion of the polyisocyanate component and/or the chain extender; (3) by employing, as a high molecular weight polyol, a polyol compound having an appropriate intermolecular cohesiveness (crystallizability); or (4) by utilizing the above-mentioned methods in combination of two or more thereof.

The use of the above-mentioned specific hydrophilic polyurethane resin to form the ink-receiving porous polymer coating layer effectively enables the resultant recording sheets to exhibit enhanced anti-blocking property, color density, continuous tone-reproducibility, dot-reproducibility and color brightness. The above-mentioned advantages of the polyurethane resin-containing ink-receiving porous polymer coating layer are derived from the specific porous structure and interfacial properties of the ink-receiving polymer layer.

Since the surface portion of the ink-receiving polymer layer has a plurality of fine pores connected to the ambient atmosphere and to each other through fine capillaries, the hot melt ink can be easily penetrate into the fine pores through the capillaries, and be stably fixed in the fine pores. Therefore, the ink-receiving polymer layer exhibits a high hot melt ink-penetrating property and an enhanced hot melt ink-receiving capacity.

Also, when the hot melt ink is transferred, the ink-receiving polymer layer of the recording sheet is brought into close contact with the ink ribbon under compressive pressure. The ink-receiving polymer (polyurethane resin) layer comprising the specific polyurethane resin and having a high compression-deformability advantageously enhance the close contact of the ink-receiving polymer layer with the ink ribbon.

Further, the ink-receiving polymer layer comprising the specific polyurethane resin exhibits a high affinity and adhesion to the hot melt ink, and thus the hot melt ink can easily penetrate into the ink-receiving polymer (polyurethane resin) layer and be stably fixed on and in the ink-receiving polymer layer.

In the ink-receiving porous polymer coating layer of the present invention, the specific polyurethane resin may be employed in combination of at least one of the above-mentioned polymeric materials other than the specific polyurethane resin.

EXAMPLES

The present invention will be further explained by the following examples which are merely representative and do not restrict the scope of the present invention in any way.

Example 1

A polymeric mixture having a solid content of 30% by weight was prepared in the following composition.

Composition of polymeric mixture

| Component | Part by solid weight |
|---|---|
| Styrene-butadiene copolymer latex (trademark: JSR 0692, made by Nihon Goseigomu K.K. solid content: 48% by weight) | 100 |
| Foam stabilizer (stearic acid derivative, trademark: SN Foam 200, made by Sun Nopco Co., solid content: 33% by weight | 5 |

The polymeric mixture was charged in an agitater (trademark: Kenmix Aiko PRO, made by Aikosha Seisakusho), and agitated at an agitating rate of 490 rpm for 15 minute to bubble the polymeric mixture. The resultant bubbled coating liquid had a bubbling ratio of 4.5.

Immediately after the bubbling, the resultant bubbled polymer coating liquid was coated in a dry amount of 10 $g/m^2$ on a front surface of a substrate sheet consisting of a fine paper sheet having a basis weight of 75 $g/m^2$ by using an applicator bar, and the resultant coating liquid layer was dried at a temperature of 110° C. for 5 minutes, to form an ink-receiving porous polymer coating layer. The resultant hot melt ink thermal transfer recording sheet was conditional at a temperature of 20° C. at a relative humidity of 65% for one night and then subjected to the following tests.

(1) Measurement of thermal conductivity

The conditioned specimen of the recording sheet was subjected to a measurement of thermal conductivity by the laser flash method as mentioned above.

(2) Printing

Specimens of the recording sheet were printed with hot melt inks by using a hot melt ink thermal transfer color-printer (modification of a sublimating dye thermal transfer printer (trademark: Trueprint 2200, made by Nihon Victor K. K.). The resultant hot melt ink images were tested in the following manner.

(3) Color density and continuous tone-reproducibility

The hot melt ink images in 17 steps of continuous color tone on a specimen were subjected to measurement of color density in each of the applied energy levels, by using a MacBeth Reflective color density meter (trademark: RD-914).

The highest color density of the transferred images was measured and the continuous tone-reproducibility of the transferred images were evaluated into the following four classes.

| Class | Continuous tone reproducibility |
|---|---|
| 4 | Excellent |
| 3 | Satisfactory |
| 2 | Bad |
| 1 | Very bad |

(4) Dot-reproducibility

The ink dots transferred from the ink ribbon to the ink-receiving porous polymer coating layer of a specimen were observed by naked eye and evaluated into the following four classes.

| Class | Dot-reproducibility |
|---|---|
| 4 | Excellent |
| 3 | Satisfactory |

-continued

| Class | Dot-reproducibility |
|---|---|
| 2 | Bad |
| 1 | Very bad |

(5) Color brightness

The ink images on the recording sheet specimen was observed by the naked eye and the color brightness of the ink images were evaluated into the following 4 classes.

| Class | Color brightness |
|---|---|
| 4 | Excellent |
| 3 | Satisfactory |
| 2 | Bad |
| 1 | Very bad |

(6) Determination of pore size

The size of pores located in the surface of the ink-receiving porous polymer coating layer of a specimen was determined by taking a photograph of the surface of the ink-receiving porous polymer coating layer by using a scanning electron microscope or an optical microscope, correctly tracing the circumferences of pores located in the surface portion of the ink-receiving layer from the photograph onto a clear-film with a black ink, optically reading the pore circumference information by using a drum scanner (trademark: 2605 type Drum scanner densitometer, made by Abe Sekkei K. K.) and analyzing the read information by an image-analyzing apparatus (trademark: Luzex III, made by Nireco K. K.). The form of the pores located in the surface portion of the ink-receiving porous polymer coating layer is not always a true circle. The size of the pore was represented by an average diameter of true circles having the same areas as those within the circumferences of the pores determined by the image analyzing apparatus.

(7) Determination of apparent density of ink-receiving porous polymer coating layer The apparent density of the ink-receiving porous polymer coating layer of a specimen was determined by calculating from the thickness and the weight of the ink-receiving layer. The weight of the ink-receiving layer was the difference between the total weight of the recording sheet specimen and the weight of the substrate sheet. Also, the thickness of the ink-receiving layer was the difference between the total thickness of the recording sheet specimen and the thickness of the substrate sheet.

(8) Determination of compression stress of the ink-receiving porous polymer coating layer A recording sheet specimen was compressed by using a tensile compression apparatus (trademark: Strograph-M2, made by Toyo Seiki Seisakusho) so that the ink-receiving porous polymer coating layer of the specimen was compressed at a compressing rate of 0.5 mm/min in the direction of thickness of the specimen, and a stress-strain curve was prepared. From the stress-strain curve, the stress in the recording sheet specimen under a compression of 10% based on the total thickness of the recording sheet specimen was determined.

(9) Bubbling ratio

A bubbling ratio is defined by the following equation:

Bubbling ratio=(Weight of non-bubbled coating liquid in a predetermined volume)/(weight of bubbled coating liquid in the same volume as the non-bubbled coating liquid)

Each weight of the non-bubbled and bubbled coating liquids was measured by filling each liquid in a container having a predetermined inner volume.

The test results are shown in Table 1.

Example 2

The same bubbled coating liquid as in Example 1 was coated in a dry weight of 20 g/m$^2$ on the same substrate sheet consisting of a fine paper sheet having a basis weight of 75 g/m$^2$, by using an applicator bar and dried under the same conditions as in Example 1, to form an ink-receiving porous polymer coating layer. The resultant recording sheet was subjected to the same tests as in Example 1.

The test results are shown in Table 1.

Example 3

The same polymeric mixture as In Example 1 was agitated for 20 minutes by the same agitater as in Example 1, to provide a bubbled polymer-containing coating liquid having a bubbling ratio of 9.0.

Immediately after the agitation procedure, the bubbled coating liquid was coated in a dry weight of 5 g/m$^2$ on a front surface of a substrate sheet consisting of a fine paper sheet with a basis weight of 75 g/m$^2$ by using an applicator bar, and dried under the same conditions as in Example 1, to form an ink-receiving porous polymer coating layer. The resultant recording sheet is subjected to the same tests as in Example 1.

The test results are shown in Table 1.

Example 4

The same bubbled polymer-containing coating liquid as in Example 1 was coated in a dry weight of 10 g/m$^2$ on a front surface of a polyethylene terephthalate (PET) film having a thickness of 100 μm and hydrophilization-treated by a corona discharge, by using an applicator bar, and dried under the same conditions as in Example 1, to form an ink-receiving porous polymer coating layer.

The resultant recording sheet was subjected to the same tests as in Example 1. The test results are shown in Table 1.

Example 5

A polymeric mixture was prepared in the following composition.

Composition of polymeric mixture

| Component | Part by solid weight |
|---|---|
| Styrene-butadiene copolymer latex (JSR 0692) | 100 |
| Kaolinite clay (trademark: HT clay, made by Engelhard Co.) | 100 |
| Foam stabilizer (SN foam 200) | 10 |

The resultant polymeric mixture having a solid content of 40% by weight was bubble-treated by the same method as in Example 1. The resultant bubbled coating liquid had a bubbling ratio of 3.0.

Immediately after the bubbling procedure, the bubbled coating liquid was coated in a dry weight of 10 g/m$^2$ on a front surface of a substrate sheet consisting of a fine paper sheet with a basis weight of 75 g/m$^2$ by using an applicator bar, and dried under the same conditions as in Example 1, to form an ink-receiving porous polymer coating layer.

The resultant recording sheet was subjected to the same tests as in Example 1.

The test results are shown in Table 1.

Example 6

The same recording sheet as in Example 5 was conditioned at a temperature of 20° C. at a relative humidity of 65% for one day and night. The conditioned recording sheet was treated by a super calender to such an extent that the resultant smoothed surface of the ink-receiving porous polymer coating layer exhibited a Bekk smoothness of 150 seconds.

The original surface of the ink-receiving layer before the super calender treatment exhibited a Bekk smoothness of 30 seconds. The super calender-treated recording sheet was subjected to the same tests as in Example 1.

The test results are shown in Table 1.

Example 7

A polymeric mixture was prepared in the following composition.

Composition of polymeric mixture

| Component | Part by solid weight |
|---|---|
| Styrene-butadiene copolymer latex (JSR 0692) | 100 |
| Kaolinite clay (trademark: HT clay, made by Engelhard Co.) | 900 |
| Foam stabilizer (SN foam 200) | 30 |

The resultant polymeric mixture having a solid content of 40% by weight was bubble-treated by the same method as in Example 1. The resultant bubbled coating liquid had a bubbling ratio of 3.0.

Immediately after the bubbling procedure, the bubbled coating liquid was coated in a dry weight of 40 g/m$^2$ on a front surface of a substrate sheet consisting of a fine paper sheet with a basis weight of 75 g/m$^2$ by using an applicator bar, and dried under the same conditions as in Example 1, to form an ink-receiving porous polymer coating layer containing a pigment.

The resultant recording sheet was subjected to the same tests as in Example 1.

The test results are shown in Table 1.

Example 8

A polymeric mixture was prepared in the following composition.

Composition of polymeric mixture

| Component | Part by solid weight |
|---|---|
| Oxidation-modified starch (trademark: Oji Ace A, made by Oji Cone Starch K.K.) | 50 |
| Polyvinyl alcohol (trademark: PVA117, made by Nihon Goseikagaku Kogyo K.K.) | 50 |
| Foam stabilizer (SN foam 200) | 5 |

The resultant polymeric mixture having a solid content of 20% by weight was bubble-treated by the same method as in Example 1. The resultant bubbled coating liquid had a bubbling ratio of 7.0.

Immediately after the bubbling procedures, the bubbled coating liquid was coated in a dry weight of 10 g/m$^2$ on a front surface of a substrate sheet consisting of a fine paper sheet with a basis weight of 75 g/m$^2$ by using an applicator bar, and dried under the same conditions as in Example 1, to form an ink-receiving porous polymer coating layer.

The resultant recording sheet was subjected to the same tests as in Example 1.

The test results are shown in Table 1.

Comparative Example 1

The same polymer-containing coating liquid as the polymeric mixture of Example 1 was coated, without bubbling, in a dry amount of 10 g/m$^2$ on a front surface of a substrate sheet consisting of a fine paper sheet with a basis weight of 75 g/m$^2$ by using an applicator bar, and dried to form a ink-receiving non-porous polymer coating layer.

The resultant recording sheet was subjected to the same tests as in Example 1.

The test results are shown in Table 1.

Comparative Example 2

The same bubbled polymer-containing coating liquid as in Example 1 was coated in a dry amount of 1.5 g/m$^2$ on a front surface of a substrate sheet consisting of a fine paper sheet with a basis weight of 75 g/m$^2$ by using an applicator bar, and dried to form a ink-receiving porous polymer coating layer.

The resultant recording sheet was subjected to the same tests as in Example 1.

The test results are shown in Table 1.

Comparative Example 3

The same polymeric mixture as in Example 1 was agitated for 25 minutes by the same agitator as in Example 1, to provide a bubbled polymer-containing coating liquid having a bubbling ratio of 12.0.

Immediately after the agitation procedure, the bubbled coating liquid was coated in a dry amount of 10 g/m$^2$ on a front surface of a substrate sheet consisting of a fine paper sheet with a basis weight of 75 g/m$^2$ by using an applicator bar, and dried under the same conditions as in Example 1, to form an ink-receiving porous polymer coating layer. The resultant recording sheet is subjected to the same tests as in Example 1.

The test results are shown in Table 1.

Comparative Example 4

A polymeric mixture was prepared in the following composition.

Composition of polymeric mixture

| Component | Part by solid weight |
|---|---|
| Styrene-butadiene copolymer latex (JSR 0692) | 100 |
| Kaolinite clay (trademark: HT clay, made by Engelhard Co.) | 1000 |
| Foam stabilizer (SN foam 200) | 35 |

The resultant polymeric mixture having a solid content of 40% by weight was bubble-treated for 25 minutes by the same agitating machine as in Example 1. The resultant bubbled coating liquid had a bubbling ratio of 3.0.

Immediately after the bubbling procedure, the bubbled coating liquid was coated in a dry amount of 30 g/m$^2$ on a front surface of a substrate sheet consisting of a fine paper sheet with a basis weight of 75 g/m$^2$ by using an applicator bar, and dried under the same conditions as in Example 1, to form an ink-receiving porous polymer coating layer.

The resultant recording sheet was subjected to the same tests as in Example 1.

The test results are shown in Table 1.

Comparative Example 5

The same bubbled polymer-containing coating liquid as in Comparative Example 4 was coated in a dry amount of 45 g/m$^2$ on a front surface of a substrate sheet consisting of a fine paper sheet with a basis weight of 75 g/m$^2$ by using an applicator bar, to form an ink-receiving porous polymer coating liquid containing a pigment.

The resultant recording sheet was subjected to the same tests as in Example 1.

The test results are shown in Table 1.

TABLE 1

| | | | Ink-receiving porous polymer coating layer | | | Recording sheet | |
|---|---|---|---|---|---|---|---|
| Example No. | Item | Bubbling ratio | Dry coating amount (g/m$^2$) | Average size of pores located in coating layer surface portion (μm) | Apparent density (g/cm$^3$) | Thermal conductivity (W/(m · K)) | Compression stress (Kg/cm$^2$) |
| Example | 1 | 4.5 | 10 | 15 | 0.20 | 0.15 | 1.5 |
| | 2 | 4.5 | 20 | 15 | 0.20 | 0.12 | 1.5 |
| | 3 | 9.0 | 5 | 30 | 0.07 | 0.10 | 0.8 |
| | 4 | 4.5 | 10 | 15 | 0.20 | 0.10 | 1.5 |
| | 5 | 3.0 | 10 | 10 | 0.30 | 0.20 | 4.5 |
| | 6 | 3.0 | 10 | 10 | 0.50 | 0.25 | 10.0 |
| | 7 | 3.0 | 40 | 5 | 0.35 | 0.25 | 4.7 |
| | 8 | 7.0 | 10 | 20 | 0.10 | 0.08 | 0.9 |
| Comparative Example | 1 | non-bubbled | 10 | — | — | 0.40 | 48.0 |
| | 2 | 4.5 | 1.5 | 15 | 0.20 | 0.35 | 1.5 |
| | 3 | 12.0 | 10 | 40 | 0.05 | 0.07 | 0.5 |
| | 4 | 3.0 | 30 | 5 | 0.35 | 0.28 | 5.0 |
| | 5 | 3.0 | 45 | 5 | 0.35 | 0.32 | 5.0 |

TABLE 1-continued

| Example No. | Item | Transferred ink images: Highest reflective color density | Continuous tone reproducibility | Dot reproducibility | Color brightness |
|---|---|---|---|---|---|
| Example | 1 | 1.38 | 4 | 4 | 4 |
| | 2 | 1.40 | 4 | 4 | 4 |
| | 3 | 1.30 | 3 | 3 | 3 |
| | 4 | 1.37 | 4 | 4 | 4 |
| | 5 | 1.32 | 4 | 4 | 4 |
| | 6 | 1.30 | 4 | 4 | 4 |
| | 7 | 1.28 | 3 | 3 | 3 |
| | 8 | 1.31 | 3 | 3 | 3 |
| Comparative Example | 1 | 0.70 | 1 | 1 | 1 |
| | 2 | 0.50 | $(*)_1$ | — | — |
| | 3 | $(*)_2$ | — | — | — |
| | 4 | 1.10 | 2 | 2 | 2 |
| | 5 | $(*)_3$ | — | — | — |

Note:
$(*)_1$ The ink image transfer was bad and the received ink images were uneven.
$(*)_2$, $(*)_3$ The coating layer was removed during the printing procedure, and thus no tests could be carried out for the transferred ink images.

Table 1 clearly indicates that the recording sheets of Examples 1 to 8 in accordance with the present invention were satisfactory in color density, continuous tone-reproducibility, dot-reproducibility and color brightness of the transferred ink images, whereas the recording sheets of Comparative Examples 1 to 5 were unsatisfactory in the above-mentioned properties.

Example 9

A resin mixture was prepared in the following composition.

Resin mixture

| Component | Part by solid weight |
|---|---|
| Aqueous polyurethane resin dispersion (trademark: Adecabontighter HUX-401, made by Asahi Denkakogyo K.K. solid content: 37% by weight) | 100 |
| Foam stabilizer (trademark: YC80C, made by Kanebo NSC K.K., main component: higher fatty acid amide, solid content: 35% by weight) | 5 |
| Thickening agent (AG Gum, made by Daiichi Kogyoseiyaku K.K. main component: carboxymethyl cellulose, solid content: 95% by weight) | 10 |

The resin mixture, having a viscosity of 20,000 cP and a total solid content of 30%, was agitated by an agitating machine (trademark: Kenmix Aiko PRO, made by Aikosha Seisakusho) at an agitating rate of 490 rpm for 10 minutes to apply a bubbling treatment to the resin mixture. The resultant bubbled coating liquid had a bubbling ratio of 4.0.

Immediately after the bubbling treatment, the resultant bubbled coating liquid was coated in a dry amount of 15 g/m$^2$ on the front surface of a substrate sheet consisting of a fine paper sheet with a basis weight of 75 g/m$^2$ by using an applicator bar, and the coating liquid layer was dried at a temperature of 110° C. for 5 minutes, to form an ink-receiving porous polymer coating layer.

The resultant recording sheet was subjected to the same tests as in Example 1. Also, the optical contact of the ink-receiving porous polymer coating layer with a prism surface was determined under a pressure of 2 kg/cm$^2$ or 10 kg/cm$^2$ at a wavelength of 0.5 μm or 1.7 μm, by the above-mentioned measurement method using a Microtopograph. Further, the following tests were carried out.

Coating property of a bubbled coating liquid

A bubbled coating liquid was coated on a front surface of a fine paper sheet by using an applicator bar. Immediately after the coating, the surface of the coating liquid layer was observed by naked eye and evaluated into the following classes.

| Class | Coating property |
|---|---|
| 4 | Excellent (very even) |
| 3 | Satisfactory (even) |
| 2 | Bad (uneven) |
| 1 | Very bad (very uneven) |

The test results are shown in Table 2.

Example 10

The same bubbled coating liquid as in Example 9 was coated on a front surface of a substrate sheet consisting of a fine paper sheet with a basis weight of 75 g/m$^2$ by using an applicator bar and dried in the same manner as in Example 9.

The resultant ink-receiving porous polymer coating layer had a dry weight of 25 g/m$^2$.

The resultant recording sheet was subjected to the same tests as in Example 9.

The test results are shown in Table 2.

Example 11

The same resin mixture as in Example 9 was agitated by the same agitating machine at an agitating rate of 490 rpm for 25 minutes, to provide a bubbled coating liquid having a bubbling ratio of 9.0.

Immediately after the agitation, the resultant bubbled coating liquid was coated on a front surface of a substrate sheet consisting of a fine paper sheet with a basis weight of 75 g/m$^2$ by using an applicator bar and dried in the same manner as in Example 9, to form an ink-receiving porous polymer coating layer having a dry weight of 5 g/m$^2$.

The resultant recording sheet was subjected to the same tests as in Example 9.

The test results are shown in Table 2.

Example 12

The same bubbled coating liquid as in Example 9 was coated on a front surface of a substrate sheet consisting of a synthetic paper sheet with a thickness of 110 μm (trademark: Yupo FPG110, made by Oji Yukagoseishi K. K.) by using an applicator bar and dried in the same manner as in Example 9.

The resultant ink-receiving porous polymer coating layer had a dry weight of 15 g/m$^2$.

The resultant recording sheet was subjected to the same tests as in Example 9.

The test results are shown in Table 2.

Example 13

The same resin mixture as in Example 9 was agitated by the same agitating machine as in Example 9 at an agitating rate of 490 rpm for 8 minutes, to provide a bubbled coating liquid having a bubbling ratio of 2.0.

Immediately after the agitation, the resultant bubbled coating liquid was coated on the front surface of a substrate sheet, consisting of a fine paper sheet with a basis weight of 75 g/m$^2$, by using an applicator bar and dried in the same manner as in Example 9, to form an ink-receiving porous polymer coating layer having a dry weight of 30 g/m$^2$.

The resultant recording sheet was subjected to the same tests as in Example 9.

The test results are shown in Table 2.

Example 14

A resin mixture was prepared in the following composition.

Resin mixture

| Component | Part by solid weight |
|---|---|
| Aqueous polyurethane resin dispersion (Adecabontighter HUX-401) | 100 |
| Kaolinite clay (trademark: HT clay, made by Engelhard Co.) | 100 |
| Foam stabilizer (trademark: DC-100A, made by Sun Nopco, main component: higher fatty acid alkali metal salt, solid content: 33% by weight) | 10 |
| Thickening agent (AG Gum) | 10 |

The resin mixture having a viscosity of 20,000 cP and a total solid content of 40% was agitated by the same method as in Example 9. The resultant bubbled coating liquid had a bubbling ratio of 3.0.

Immediately after the bubbling treatment, the resultant bubbled coating liquid was coated in a dry amount of 15 g/m$^2$ on the front surface of a substrate sheet, consisting of a fine paper sheet with a basis weight of 75 g/m$^2$, by using an applicator bar, and dried in the same manner as in Example 9 to form an ink-receiving porous polymer coating layer.

The resultant recording sheet was subjected to the same tests as in Example 9.

The test results are shown in Table 2.

Example 15

The same procedures and tests as in Example 14 were carried out, except that the resultant recording sheet was conditioned at a temperature of 20° C. at a relative humidity of 65% for 24 hours, and then smoothed with a super calender.

The test results are shown in Table 2.

Example 16

A resin mixture was prepared in the following composition.

Resin mixture

| Component | Part by solid weight |
|---|---|
| Aqueous polyurethane resin dispersion (Adecabontighter HUX-401) | 100 |
| Kaolinite clay (HT clay) | 900 |
| Foam stabilizer (DC-100A) | 30 |
| Thickening agent (AG Gum) | 10 |

The resin mixture having a viscosity of 20,000 cP and a total solid content of 40% was agitated by the same procedures as in Example 9. The resultant bubbled coating liquid had a bubbling ratio of 3.0.

Immediately after the bubbling treatment, the resultant bubbled coating liquid was coated in a dry amount of 15 g/m$^2$ on the front surface of a substrate sheet consisting of a fine paper sheet with a basis weight of 75 g/m$^2$ by using an applicator bar, dried in the same manner as in Example 9 to form an ink-receiving porous polymer coating layer.

The resultant recording sheet was subjected to the same tests as in Example 9.

The test results are shown in Table 2.

Example 17

A resin mixture was prepared in the following composition.

Resin mixture

| Component | Part by solid weight |
|---|---|
| Aqueous polyurethane resin dispersion (Adecabontighter HUX-401) | 50 |
| SBR latex (trademark: L-1612, made by Asahi Kaseikogyo K.K. solid content: 48% by weight) | 50 |
| Foam stabilizer (YC 80C) | 5 |
| Thickening agent (AG Gum) | 10 |

The resin mixture having a viscosity of 20,000 cP and a total solid content of 30% was agitated by same procedures as in Example 9. The resultant bubbled coating liquid had a bubbling ratio of 4.0.

Immediately after the bubbling treatment, the resultant bubbled coating liquid was coated in a dry amount of 15 g/m$^2$ on the front surface of a substrate sheet consisting of a fine paper sheet with a basis weight of 75 g/m$^2$ by using an applicator bar, and dried by the same procedures as in Example 9, to form an ink-receiving porous polymer coating layer.

The resultant recording sheet was subjected to the same tests as in Example 9.

The test results are shown in Table 2.

Example 18

A resin mixture was prepared in the following composition.

Resin mixture

| Component | Part by solid weight |
|---|---|
| Aqueous polyurethane resin dispersion (Adecabontighter HUX-401) | 50 |
| Oxidized starch (trademark: 0ji Ace A, made by 0ji Corn Starch K.K.) | 50 |
| Foam stabilizer (YC 80C) | 5 |
| Thickening agent (AG Gum) | 10 |

The resin mixture having a viscosity of 20,000 cP and a total solid content of 25% was agitated by the same procedures as in Example 9. The resultant bubbled coating liquid had a bubbling ratio of 4.0.

Immediately after the bubbling treatment, the resultant bubbled coating liquid was coated in a dry amount of 15 g/m$^2$ on the front surface of a substrate sheet, consisting of a fine paper sheet with a basis weight of 75 g/m$^2$, by using an applicator bar, and dried by the same procedures as in Example 9, to form an ink-receiving porous polymer coating layer.

The resultant recording sheet was subjected to the same tests as in Example 9.

The test results are shown in Table 2.

Example 19

A resin mixture was prepared in the following composition.

Resin mixture

| Component | Part by solid weight |
|---|---|
| SBR latex (L-1612) | 100 |
| Foam stabilizer (YC 80C) | 5 |
| Thickening agent (AG Gum) | 10 |

The resin mixture having a viscosity of 20,000 cP and a total solid content of 30% was agitated by the same procedures as in Example 9. The resultant bubbled coating liquid had a bubbling ratio of 4.0.

Immediately after the bubbling treatment, the resultant bubbled coating liquid was coated in a dry amount of 15 g/m$^2$ on a front surface of a substrate sheet consisting of a fine paper sheet with a basis weight of 75 g/m$^2$ by using an applicator bar, and dried by the same procedures as in Example 9, to form an ink-receiving porous polymer coating layer.

The resultant recording sheet was subjected to the same tests as in Example 9.

The test results are shown in Table 2.

Example 20

The same resin mixture as in Example 9 was agitated by the same agitating machine as in Example 9 at an agitating rate of 490 rpm for 13 minutes, to provide a bubbled coating liquid having a bubbling ratio of 5.0.

Immediately after the agitation, the resultant bubbled coating liquid was coated on the front surface of a substrate sheet, consisting of a fine paper sheet with a basis weight of 75 g/m$^2$, by using an applicator bar and dried in the same manner as in Example 9, to form an ink-receiving porous polymer coating layer having a dry weight of 15 g/m$^2$.

The resultant recording sheet was subjected to the same tests as in Example 9.

The test results are shown in Table 2.

Example 21

A resin mixture was prepared in the following composition.

Composition of resin mixture

| Component | Part by solid weight |
|---|---|
| Aqueous polyurethane resin dispersion (Adecabontighter HUX-401) | 100 |
| Foam stabilizer (YC 80C) | 5 |
| Thickening agent (AG Gum) | 4 |

The resin mixture having a viscosity of 6,000 cP and a solid content of 35% by weight was agitated by the same agitating conditions as in Example 9, for 6 minutes, to provide a bubbled coating liquid having a bubbling ratio of 4.0.

Immediately after the agitation treatment, the resultant bubbled coating liquid was coated in a dry amount of 15 g/m$^2$ on the front surface of a substrate sheet, consisting of a fine paper sheet having a basis weight of 75 g/m$^2$, by using an applicator bar, and dried in the same manner as in Example 9, to form an ink receiving porous polymer coating layer.

The resultant recording sheet was subjected to the same tests as in Example 9.

The test results are shown in Table 2.

Example 22

A resin mixture was prepared in the following composition.

Composition of resin mixture

| Component | Part by solid weight |
|---|---|
| Aqueous polyurethane resin dispersion (Adecabontighter HUX-401) | 100 |
| Foam stabilizer (YC 80C) | 5 |
| Thickening agent (AG Gum) | 15 |

The resin mixture having a viscosity of 50,000 cP and a solid content of 25% by weight was agitated by the same agitating conditions as in Example 9, for 12 minutes, to provide a bubbled coating liquid having a bubbling ratio of 4.0.

Immediately after the agitation treatment, the resultant bubbled coating liquid was coated in a dry amount of 15 g/m$^2$ on the front surface of a substrate sheet, consisting of a fine paper sheet having a basis weight of 75 g/m$^2$, by using an applicator bar, and dried in the same manner as in Example 9, to form an ink receiving porous polymer coating layer.

The resultant recording sheet was subjected to the same tests as in Example 9.

The test results are shown in Table 2.

Example 23

A resin mixture was prepared in the following composition.

Composition of resin mixture

| Component | Part by solid weight |
|---|---|
| Aqueous polyurethane resin dispersion (Adecabontighter HUX-401) | 100 |
| Foam stabilizer (YC 80C) | 5 |
| Thickening agent (AG Gum) | 15 |
| Thickening agent (polyacrylic acid sodium salt, trademark; Modicol VD-S, made by Sunnopco Co.) | 5 |

The resin mixture having a viscosity of 100,000 cP and a solid content of 25% by weight was agitated by the same agitating conditions as in Example 9, for 12 minutes, to provide a bubbled coating liquid having a bubbling ratio of 4.0.

Immediately after the agitation treatment, the resultant bubbled coating liquid was coated in a dry amount of 15 g/m$^2$ on the front surface of a substrate sheet consisting of a fine paper sheet having a basis weight of 75 g/m$^2$, by using an applicator bar, and dried in the same manner as in Example 9, to form an ink receiving porous polymer coating layer.

The resultant recording sheet was subjected to the same tests as in Example 9.

The test results are shown in Table 2.

Comparative Example 6

The same aqueous resin mixture as in Example 9 was coated, without bubbling, on the front surface of a substrate sheet, consisting of a fine paper sheet with a basis weight of 75 g/m$^2$, by using an applicator bar, to form an ink-receiving polymer coating layer having a dry weight of 15 g/m$^2$.

The resultant recording sheet was subjected to the same tests as in Example 9.

The test results are shown in Table 2.

Comparative Example 7

The same bubbled coating liquid as in Example 9 was coated on a front surface of a substrate sheet consisting of a fine paper sheet with a basis weight of 75 g/m$^2$ and dried in the same manner as in Example 9.

The resultant ink-receiving porous polymer coating layer had a dry weight of 1.5 g/m$^2$.

The resultant recording sheet was subjected to the same tests as in Example 9.

The test results are shown in Table 2.

Comparative Example 8

The same resin mixture as in Example 9 was agitated by the same agitating machine at an agitating rate of 490 rpm for 30 minutes, to provide a bubbled coating liquid having a bubbling ratio of 12.0.

Immediately after the agitation, the resultant bubbled coating liquid was coated on the front surface of a substrate sheet, consisting of a fine paper sheet with a basis weight of 75 g/m$^2$, by using an applicator bar and dried in the same manner as in Example 9, to form an ink-receiving porous polymer coating layer having a dry weight of 5 g/m$^2$.

The resultant recording sheet was subjected to the same tests as in Example 9.

The test results are shown in Table 2.

Comparative Example 9

A resin mixture was prepared in the following composition.

Resin mixture

| Component | Part by solid weight |
|---|---|
| Aqueous polyurethane resin dispersion (Adecabontighter HUX-401) | 100 |
| Kolinite clay (HT clay) | 1000 |
| Foam stabilizer (DC-100A) | 30 |
| Thickening agent (AG Gum) | 10 |

The resin mixture (having a total solid content of 40%) was agitated by the same agitating machine as in Example 1 at an agitating rate of 490 rpm for 25 minutes to apply a bubbling treatment to the resin mixture. The resultant bubbled coating liquid had a bubbling ratio of 3.0.

Immediately after the bubbling treatment, the resultant bubbled coating liquid was coated in a dry amount of 15 g/m$^2$ on the front surface of a substrate sheet, consisting of a fine paper sheet with a basis weight of 75 g/m$^2$, by using an applicator bar, and dried by the same procedures as in Example 9, to form an ink-receiving porous polymer coating layer.

The resultant recording sheet was subjected to the same tests as in Example 9.

The test results are shown in Table 2.

Comparative Example 10

A resin mixture was prepared in the following composition.

Composition of resin mixture

| Component | Part by solid weight |
|---|---|
| Aqueous polyurethane resin dispersion (Adecabontighter HUX-401) | 100 |
| Foam stabilizer (YC 80C) | 5 |
| Thickening agent (AG Gum) | 2.5 |

The resin mixture having a viscosity of 3,000 cP and a solid content of 35% by weight was agitated by the same agitating conditions as in Example 9, for 6 minutes, to provide a bubbled coating liquid having a bubbling ratio of 4.0.

Immediately after the agitation treatment, the resultant bubbled coating liquid was coated in a dry amount of 15 g/m$^2$ on the front surface of a substrate sheet, consisting of a fine paper sheet having a basis weight of 75 g/m$^2$, by using an applicator bar, and dried in the same manner as in Example 9, to form an ink receiving porous polymer coating layer.

The resultant recording sheet was subjected to the same tests as in Example 9.

The test results are shown in Table 2.

TABLE 2

| Example No. | Item | Viscosity of non-bubbled coating liquid (cP) | Bubbled coating liquid: Bubbling ratio | Bubbled coating liquid: Coating property | Dry weight of coating layer ($g/m^2$) | Ink-receiving porous polymer coating layer: Average size of pores (μm) | Ink-receiving porous polymer coating layer: Apparent density ($g/cm^3$) | Ink-receiving porous polymer coating layer: Optical contact (%) 2 $Kg/cm^2$ 0.5 μm |
|---|---|---|---|---|---|---|---|---|
| Example | 9 | 20,000 | 4.0 | 4 | 15 | 6 | 0.25 | 18.0 |
| | 10 | 20,000 | 4.0 | 4 | 25 | 6 | 0.25 | 18.0 |
| | 11 | 20,000 | 9.0 | 4 | 5 | 20 | 0.07 | 60.0 |
| | 12 | 20,000 | 4.0 | 4 | 15 | 6 | 0.25 | 19.0 |
| | 13 | 20,000 | 2.0 | 4 | 30 | 10 | 0.40 | 6.7 |
| | 14 | 20,000 | 3.0 | 4 | 15 | 12 | 0.30 | 15.3 |
| | 15 | 20,000 | 3.0 | 4 | 15 | 12 | 0.50 | 23.0 |
| | 16 | 20,000 | 3.0 | 4 | 15 | 25 | 0.35 | 11.3 |
| | 17 | 20,000 | 4.0 | 4 | 15 | 9 | 0.25 | 17.5 |
| | 18 | 20,000 | 4.0 | 4 | 15 | 15 | 0.20 | 14.0 |
| | 19 | 20,000 | 4.0 | 4 | 15 | 10 | 0.25 | 16.0 |
| | 20 | 20,000 | 5.0 | 4 | 15 | 6 | 0.17 | 29.5 |
| | 21 | 6,000 | 4.0 | 4 | 15 | 10 | 0.25 | 19.9 |
| | 22 | 50,000 | 4.0 | 4 | 15 | 6 | 0.25 | 17.3 |
| | 23 | 100,000 | 4.0 | 3 | 15 | 7 | 0.25 | 18.3 |
| Comparative Example | 6 | 20,000 | Non-bubbled | 3 | 15 | — | — | 4.5 |
| | 7 | 20,000 | 4.0 | 3 | 1.5 | 8 | 0.25 | 5.5 |
| | 8 | 20,000 | 12.0 | 3 | 5 | 32 | 0.05 | 70.0 |
| | 9 | 20,000 | 3.0 | 3 | 15 | 35 | 0.55 | 9.5 |
| | 10 | 3,000 | 4.0 | 3 | 15 | 36 | 0.25 | 17.5 |

| Example No | Item | Recording sheet: Thermal conductivity (W/(m· K)) | Recording sheet: Compression stress ($kg/cm^2$) | Hot melt ink images: Highest color density | Hot melt ink images: Continuous tone-reproducibility | Hot melt ink images: Dot-reproducibility | Hot melt ink images: Color brightness |
|---|---|---|---|---|---|---|---|
| Example | 9 | 0.18 | 2.8 | 1.33 | 4 | 4 | 4 |
| | 10 | 0.15 | 2.7 | 1.37 | 4 | 4 | 4 |
| | 11 | 0.10 | 0.9 | 1.25 | 3 | 3 | 3 |
| | 12 | 0.10 | 2.8 | 1.32 | 4 | 4 | 4 |
| | 13 | 0.25 | 9.8 | 1.28 | 3 | 3 | 3 |
| | 14 | 0.20 | 4.6 | 1.27 | 4 | 4 | 4 |
| | 15 | 0.25 | 10.0 | 1.31 | 4 | 4 | 4 |
| | 16 | 0.25 | 4.8 | 1.24 | 3 | 3 | 3 |
| | 17 | 0.18 | 2.8 | 1.30 | 4 | 4 | 4 |
| | 18 | 0.15 | 2.3 | 1.25 | 3 | 3 | 3 |
| | 19 | 0.18 | 2.7 | 1.27 | 4 | 4 | 4 |
| | 20 | 0.09 | 1.2 | 1.35 | 4 | 4 | 4 |
| | 21 | 0.18 | 2.8 | 1.27 | 4 | 4 | 4 |
| | 22 | 0.18 | 2.7 | 1.36 | 4 | 4 | 4 |
| | 23 | 0.18 | 2.7 | 1.31 | 4 | 4 | 4 |
| Comparative Example | 6 | 0.45 | 50.0 | 0.35 | 1 | 1 | 1 |
| | 7 | 0.30 | 2.0 | 0.56 | 1 | 1 | 1 |
| | 8 | 0.08 | 0.5 | $(*)_1$ | — | — | — |
| | 9 | 0.26 | 5.1 | 0.95 $(*)_2$ | 2 | 2 | 2 |
| | 10 | 0.18 | 2.8 | 1.10 | 2 | 2 | 2 |

Note:
$(*)_1$ The ink-receiving layer was removed and thus the images could not be evaluated.
$(*)_2$ The ink-receiving layer was sometimes removed.

Example 24

Preparation of polyurethane resin

An aqueous polyurethane resin dispersion was prepared by mixing 200 parts by weight of a polyesterpolyol prepared by the polycondensation of 1,6-hexanediol with adipic acid and isophthalic acid, provided with hydroxyl groups located at the terminals of the polymer molecules and having an average molecular weight of 2,000, with 6 parts by weight of trimethylolpropane, 112 parts by weight of dicyclohexylmethanediisocyanate (hydrogenated MDI), 112 parts by weight of N-methylpyrrolidone, 16 parts by weight of 2,2-bis(hydroxymethyl) propionic acid and 15 parts by weight of triethylamine; and subjecting the mixture to a polyaddition reaction while stirring at a temperature of 60° to 70° C. for 3 hours. To the resultant reaction product mixture, 430 parts by weight of water and 10 parts by weight of ethylenediamine were added. The mixture was stirred at a temperature of 40° to 45° C. for 2 hours, to prepare an aqueous dispersion (1) containing a polyurethane resin in a solid content of 38% by weight.

When dry film was prepared from the polyurethane resin-containing liquid, the film exhibited a tensile strength of 450 $kg/cm^2$, an ultimate elongation of 300% and a 100% modulus of elasticity of 280 $kg/cm^2$.

Production of hot melt ink thermal transfer recording sheet

A resin mixture was prepared in the following composition.

Resin mixture

| Component | Part by solid weight |
|---|---|
| Aqueous polyurethane resin dispersion (1) | 100 |
| Foam stabilizer (SN Foam 200) | 5 |
| Thickening agent (AG Gum) | 10 |

The resin mixture (having a total solid content of 33% was agitated by an agitating machine (trademark: Kenmix Aiko RRO, made by Aikosha Seisakusho) at an agitating rate of 490 rpm for 15 minutes to apply a bubbling treatment to the resin mixture. The resultant bubbled coating liquid had a bubbling ratio of 4.0.

Immediately after the bubbling treatment, the resultant bubbled coating liquid was coated in a dry amount of 15 g/m$^2$ on the front surface of a substrate sheet consisting of a fine paper sheet with a basis weight of 75 g/m$^2$, by using an applicator bar, and the coating liquid layer was dried at a temperature of 110° C. for 5 minutes, to form an ink-receiving porous polymer coating layer.

The resultant recording sheet was subjected to the same tests as in Example 1. Also, 10 recording sheets cut into a square form having a side length of 10 cm and superposed on each other so that each ink-receiving layer surface of the recording sheets comes into contact with the back surface of the substrate sheet layer of each adjacent recording sheet, were placed on a mirror-finished upper surface of a stainless steel bottom sheet (10 cm×10 cm), and then a stainless steel top sheet (10 cm×10 cm) having a mirror-finished lower surface was placed on the recording sheets so that the mirror-finished surfaces of the stainless steel bottom and top plates come into contact with the recording sheets and a weight was placed on the stainless steel top plate so that a load of 50 g/cm$^2$ is applied to the recording sheets. The resultant testing assembly was left to stand at a temperature of 50° C. at a relative humidity of 80% for 24 hours. Thereafter, the assembly was released and the individual recording sheets were separated from each other by hand. The separatability of the recording sheets was evaluated into the following four classes.

| Class | Separatability |
|---|---|
| 4 | Excellent (no resistance to separation) |
| 3 | Satisfactory (slightly resistant to separation) |
| 2 | Bad (no breakage occurs) |
| 1 | Very bad (breakage occurs) |

The test results are shown in Table 3.

Example 25

Preparation of polyurethane resin

The same procedures as in Example 24 were carried out except that the hydrogenated MDI was replaced by 108 parts by weight of isophorone diisocyanate, and the resultant aqueous liquid (2) contained the resultant polyurethane resin in a solid content of 37% by weight.

The dry film prepared from the aqueous polyurethane resin dispersion exhibited the following physical properties.

Tensile strength: 450 kg/cm$^2$

Ultimate elongation: 340%

100% modulus of elasticity: 180 kg/cm$^2$

Production of hot melt ink thermal transfer recording sheet

A resin mixture was prepared in the following composition.

Resin mixture

| Component | Part by solid weight |
|---|---|
| Aqueous polyurethane resin dispersion (2) | 100 |
| Foam stabilizer (SN Foam 200) | 5 |
| Thickening agent (AG Gum) | 10 |

The resin mixture having a total solid content of 33% was agitated by the same procedures as in Example 24 except that the bubbling ratio was 3.9 and the resultant ink-receiving layer had a dry weight of 15 g/m$^2$.

The resultant recording sheet was subjected to the same tests as in Example 24.

The test results are shown in Table 3.

Example 26

Preparation of polyurethane resin

The same procedures as in Example 24 were carried out except that the trimethylolpropane was replaced by 6 parts by weight of melamine, the reaction and stirring temperature was 90° to 100° C., and the resultant aqueous dispersion (3) contained the resultant polyurethane resin in a solid content of 37% by weight.

The dry film prepared from the aqueous polyurethane resin dispersion (3) exhibited the following physical properties.

Tensile strength: 490 kg/cm$^2$

Ultimate elongation: 180%

100% modulus of elasticity: 320 kg/cm$^2$

Production of hot melt ink thermal transfer recording sheet

A resin mixture was prepared in the following composition.

Resin mixture

| Component | Part by solid weight |
|---|---|
| Aqueous polyurethane resin dispersion (3) | 100 |
| Foam stabilizer (SN Foam 200) | 5 |
| Thickening agent (AG Gum) | 10 |

The resin mixture having a total solid content of was agitated by the same procedures as in Example 24 except that the bubbling ratio was 4.1 and the resultant ink-receiving layer had a dry weight of 15 g/m$^2$.

The resultant recording sheet was subjected to the same tests as in Example 24.

The test results are shown in Table 3.

Example 27

Preparation of polyurethane resin

The same procedures as in Example 24 were carried out except that the trimethylolpropane was employed in an amount of 6 parts by weight, and the resultant aqueous dispersion (4) contained the resultant polyurethane resin in a solid content of 38% by weight.

The dry film prepared from the aqueous polyurethane resin dispersion (4) exhibited the following physical properties.

Tensile strength: 270 kg/cm$^2$

Ultimate elongation: 160%

100% modulus of elasticity: 230 kg/cm$^2$

Production of hot melt ink thermal transfer recording sheet

A resin mixture was prepared in the following composition.

Resin mixture

| Component | Part by solid weight |
|---|---|
| Aqueous polyurethane resin dispersion (4) | 100 |
| Foam stabilizer (SN Foam 200) | 5 |
| Thickening agent (AG Gum) | 10 |

The resin mixture having a total solid content of 33% was agitated by the same procedures as in Example 24 except that the bubbling ratio was 4.0 and the resultant ink-receiving layer had a dry weight of 15 g/m$^2$.

The resultant recording sheet was subjected to the same tests as in Example 24.

The test results are shown in Table 3.

Example 28

Preparation of polyurethane resin

The same procedures as in Example 24 were carried out except that 200 parts by weight of the polyesterpolyol prepared by the polycondensation of 1,6-hexanediol with adipic acid and isophthalic acid, provided with terminal hydroxyl groups and having an average molecular weight of 2,000, was replaced by 100 parts by weight of another polyesterpolyol prepared from neopentylglycol and adipic acid, provided with terminal hydroxyl groups and having an average molecular weight of 1,000, the water was added in an amount of 310 parts by weight, and the resultant aqueous dispersion (5) contained the resultant polyurethane resin in a solid content of 38% by weight.

The dry film prepared from the aqueous polyurethane resin dispersion exhibited the following physical properties.

Tensile strength: 500 kg/cm$^2$

Ultimate elongation: 180%

100% modulus of elasticity: 330 kg/cm$^2$

Production of hot melt ink thermal transfer recording sheet

A resin mixture was prepared in the following composition.

Resin mixture

| Component | Part by solid weight |
|---|---|
| Aqueous polyurethane resin dispersion (5) | 100 |
| Foam stabilizer (SN Foam 200) | 5 |
| Thickening agent (AG Gum) | 10 |

The resin mixture having a total solid content of 33% was agitated by the same procedures as in Example 24 at the bubbling ratio was 3.9 except that the substrate sheet consisted of a synthetic paper sheet (trademark: Yupo FPG110, made by Oji Yukagoseishi K. K. thickness: 110 μm), and the resultant ink-receiving layer had a dry weight of 15 g/m$^2$.

The resultant recording sheet was subjected to the same tests as in Example 24.

The test results are shown in Table 3.

Example 29

Preparation of polyurethane resin

An aqueous polyurethane resin dispersion (6) was prepared by mixing 200 parts by weight of a polyesterpolyol prepared by the polycondensation of 1,6-hexanediol with adipic acid and isophthalic acid, provided with hydroxyl groups located at the terminals of the polymer molecules and having an average molecular weight of 2,000, with 80 parts by weight of dicyclohexylmethanediisocyanate (hydrogenated MDI), 98 parts by weight of N-methylpyrrolidone, 10 parts by weight of 2,2-bis(hydroxymethyl) propionic acid and 10 parts by weight of triethylamine; and subjecting the mixture to a polyaddition reaction while stirring at a temperature of 60° to 70° C. for 3 hours. To the resultant reaction product mixture, 361 parts by weight of water and 6 parts by weight of ethylenediamine were added. The mixture was stirred at a temperature of 40° to 45° C. for 2 hours, to prepare an aqueous dispersion (6) containing a polyurethane resin in a solid content of 38% by weight.

When dry film was prepared from the aqueous polyurethane resin dispersion the film exhibited a tensile strength of 500 kg/cm$^2$, an ultimate elongation of and a 100% modulus of elasticity of 20 kg/cm$^2$.

Production of hot melt ink thermal transfer recording sheet

A resin mixture was prepared in the following composition.

Resin mixture

| Component | Part by solid weight |
|---|---|
| Aqueous polyurethane resin dispersion (6) | 100 |
| Foam stabilizer (SN Foam 200) | 5 |
| Thickening agent (AG Gum) | 10 |

The resin mixture having a total solid content of 33% was agitated by the same procedures as in Example 24 except that the bubbling ratio was 4.0 and the resultant ink-receiving layer had a dry weight of 15 g/m$^2$.

The resultant recording sheet was subjected to the same tests as in Example 24.

The test results are shown in Table 3.

Example 30

Preparation of polyurethane resin

An aqueous polyurethane resin dispersion (7) was prepared by mixing 200 parts by weight of a polyesterpolyol prepared by the polycondensation of 1,6-hexanediol with adipic acid and isophthalic acid, provided with hydroxyl groups located at the terminals of the polymer molecules and having an average molecular weight of 1,000, with 180 parts by weight of dicyclohexylmethanediisocyanate (hydrogenated MDI), 138 parts by weight of N-methylpyrrolidone, 17 parts by weight of 2,2-bis(hydroxymethyl) propionic acid and 13 parts by weight of triethylamine; and subjecting the mixture to a polyaddition reaction while stirring at a temperature of 60° to 70° C. for 3 hours. To the resultant reaction product mixture, 530 parts by weight of water and 12 parts by weight of ethylenediamine were added. The mixture was stirred at a temperature of 40° to 45° C. for 2 hours, to prepare an aqueous dispersion (7) containing a polyurethane resin in a solid content of 38% by weight.

When a dry film was prepared from the aqueous polyurethane resin dispersion the film exhibited a tensile strength of 500 kg/cm$^2$, an ultimate elongation of 150% and a 100% modulus of elasticity of 450 kg/cm$^2$.

Production of hot melt ink thermal transfer recording sheet

A resin mixture was prepared in the following composition.

Resin mixture

| Component | Part by solid weight |
|---|---|
| Aqueous polyurethane resin dispersion (7) | 100 |
| Foam stabilizer (SN Foam 200) | 5 |
| Thickening agent (AG Gum) | 10 |

The resin mixture having a total solid content of 33% was agitated by the same procedures as in Example 24 except that the bubbling ratio was 3.9 and the resultant ink-receiving layer had a dry weight of 15 g/m$^2$.

The resultant recording sheet was subjected to the same tests as in Example 24.

The test results are shown in Table 3.

TABLE 3

| | | Polyurethane resin | | Ink-receiving porous polymer coating layer | | | | Recording sheet | |
|---|---|---|---|---|---|---|---|---|---|
| Example No. | Item | Type | 100% modulus of elasticity of film (kg/cm$^2$) | Bubbling ratio | Dry weight of coating layer (g/m$^2$) | Average size of pores (μm) | Apparent density (g/cm$^3$) | Thermal conductivity (W/(m · K)) | Anti-blocking property |
| Example | 24 | (1) | 280 | 4.0 | 15 | 8 | 0.25 | 0.18 | 4 |
| | 25 | (2) | 180 | 3.9 | 15 | 7 | 0.25 | 0.17 | 3 |
| | 26 | (3) | 320 | 4.1 | 15 | 8 | 0.25 | 0.18 | 4 |
| | 27 | (4) | 230 | 4.0 | 15 | 9 | 0.25 | 0.19 | 4 |
| | 28 | (5) | 330 | 3.9 | 15 | 7 | 0.25 | 0.17 | 4 |
| | 29 | (6) | 20 | 4.0 | 15 | 8 | 0.25 | 0.18 | 3 |
| | 30 | (7) | 450 | 3.9 | 15 | 7 | 0.25 | 0.18 | 4 |

| | | Hot melt ink images | | | |
|---|---|---|---|---|---|
| Example No. | Item | Highest color density | Continuous tone reproducibility | Dot-reproducibility | Color brightness |
| Example | 24 | 1.38 | 4 | 4 | 4 |
| | 25 | 1.34 | 4 | 4 | 4 |
| | 26 | 1.36 | 4 | 4 | 4 |
| | 27 | 1.34 | 4 | 4 | 4 |
| | 28 | 1.37 | 4 | 4 | 4 |
| | 29 | 1.31 | 3 | 3 | 3 |
| | 30 | 1.32 | 3 | 3 | 3 |

We claim:

1. A hot melt ink thermal transfer recording sheet comprising:

a substrate sheet; and an ink-receiving porous polymer coating layer comprising a polymeric material, laminated on a surface of the substrate sheet, provided with a plurality of pores of which those distributed in the surface portion thereof have an average size of 0.5 to 30 μm, and having an apparent density of 0.05 to 0.5 g/cm$^3$, the laminate of the substrate sheet with the ink-receiving porous polymer coating layer having a thermal conductivity of 0.25 W/(m.K) or less, determined by the laser flash method.

2. The hot melt ink thermal transfer recording sheet as claimed in claim 1, wherein the ink-receiving porous polymer coating layer exhibits a stress of 10 kg/cm$^2$ or less under a compression of 10% in thickness in the direction of thickness thereof.

3. The hot melt ink thermal transfer recording sheet as claimed in claim 1, wherein the ink-receiving porous polymer coating layer exhibits an optical contact with a prism surface of 6% or more under a pressure of 2 kg/cm$^2$.

4. The hot melt ink thermal transfer recording sheet as claimed in claim 3, wherein the optical contact of the ink-receiving porous polymer coating layer with the prism surface is 6 to 65% under a pressure of 2 kg/cm$^2$.

5. A process for producing the hot melt ink thermal transfer recording sheet as claimed in any one of claims 1 to 4, comprising the steps of:

mechanically agitating a coating liquid containing a polymeric material to an extent such that a large number of fine air bubbles independent, from each other and having an average size of 0.5 to 30 μm are introduced into the coating liquid and the resultant bubbled coating liquid has a total volume larger than but not more than 10 times the original volume of the non-bubbled coating liquid;

coating a surface of a substrate sheet with the bubbled coating liquid; and drying the coated bubbled coating liquid layer to provide an ink-receiving porous polymer coating layer.

6. The hot melt ink thermal transfer recording sheet as claimed in claim 1, wherein the porous polymer coating liquid for the ink-receiving porous polymer coating layer comprises a polymeric material and a pigment.

7. The hot melt ink thermal transfer recording sheet as claimed in claim 6, wherein the pigment for the ink-receiving porous polymer coating layer comprises at least one member selected from the group consisting of zinc oxide, titanium dioxide, calcium carbonate, silicon dioxide, silicates, clay, talc, mica, calcined clay, aluminum hydroxide, barium sulfate, lithopone, colloidal silica, polystyrene, polyethylene, polypropylene, epoxy resins, styrene-acrylic compound copolymers, starch and cellulose.

8. The hot melt ink thermal transfer recording sheet as claimed in claim 6, wherein the pigment for the ink-receiving porous polymer coating layer is present in an amount of 900 parts by weight or less per 100 parts by weight of the polymeric material.

9. The hot melt ink thermal transfer recording sheet as claimed in claim 1, wherein the polymeric material for the ink-receiving porous polymer coating layer comprises at least one member selected from the group consisting of polyvinyl alcohols, starches, methoxycellulose, carboxymethyl cellulose, methyl cellulose, ethyl cellulose, polyacrylic acid sodium salt, polyvinyl pyrrolidone, acrylic acid amide-acrylic acid ester copolymers, acrylic acid amide-acrylic acid ester-methacrylic acid ester copolymers, alkali metal salts of styrene-maleic anhydride copolymers, polyacrylic acid amides, polyethylene glycol, polyvinyl acetate, polyurethanes, styrene-butadiene copolymers, acrylonitrile-butadiene copolymers, polyacrylic acid esters, vinyl chloride-vinyl acetate copolymers, polybutyl methacrylate, ethylene-vinyl acetate copolymers, styrene-butadiene-acrylic compound copolymers, polyvinylidene chloride, glue, casein, soybean protein, gelatin and sodium alginate.

10. The hot melt ink thermal transfer recording sheet as claimed in claim 1, wherein the ink-receiving porous polymer coating layer is present in an amount of 2 to 40 $g/m^2$.

11. The hot melt ink thermal transfer recording sheet as claimed in claim 1, wherein the ink-receiving porous polymer coating layer is formed from an aqueous dispersion containing a polyurethane resin.

12. The hot melt ink thermal transfer recording sheet as claimed in claim 4, wherein the polyurethane resin has a 100% modulus of elasticity of 50 to 400 $kg/cm^2$.

13. The hot melt ink thermal transfer recording sheet as claimed in claim 4, wherein the aqueous polyurethane resin dispersion has been prepared by polyaddition reacting a polyisocyanate component with a polyol component comprising a high molecular weight polyol compound and a low molecular weight polyol compound having at least one member selected from carboxyl and sulfonic groups, in a reaction medium which is inert to the polyaddition reaction and soluble in water, and dissolving the reaction product mixture in water.

14. The hot melt ink thermal transfer recording sheet as claimed in claim 13, wherein the low molecular weight polyol compound having at least one member selected from carboxyl and sulfonic groups is employed in an amount of 0.5 to 50% by weight based on the total weight of all the reaction components for the polyurethane resin.

15. The hot melt ink thermal transfer recording sheet as claimed in claim 13, wherein the reaction medium comprises at least one member selected from the group consisting of acetone, methylethyl ketone, dioxane, tetrahydrofuran and N-methyl-2-pyrrolidone.

* * * * *